US012467230B2

(12) United States Patent
Hamamoto et al.

(10) Patent No.: US 12,467,230 B2
(45) Date of Patent: Nov. 11, 2025

(54) WORKING MACHINE

(71) Applicant: KUBOTA CORPORATION, Osaka (JP)

(72) Inventors: Ryota Hamamoto, Sakai (JP); Hiroaki Nakagawa, Sakai (JP); Yuji Fukuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 468 days.

(21) Appl. No.: 17/953,535

(22) Filed: Sep. 27, 2022

(65) Prior Publication Data

US 2024/0102263 A1 Mar. 28, 2024

(51) Int. Cl.

| | |
|---|---|
| ***E02F 9/20*** | (2006.01) |
| ***E02F 9/24*** | (2006.01) |
| ***E02F 9/26*** | (2006.01) |
| *E02F 9/22* | (2006.01) |

(52) U.S. Cl.

CPC ..... *E02F 9/2033* (2013.01); *E02F 9/24* (2013.01); *E02F 9/262* (2013.01); *E02F 9/265* (2013.01); *E02F 9/2228* (2013.01); *E02F 9/2285* (2013.01); *E02F 9/2292* (2013.01); *E02F 9/2296* (2013.01)

(58) Field of Classification Search

CPC ..... E02F 9/2033; E02F 9/24; E02F 9/262; E02F 9/265; E02F 9/2228; E02F 9/2285; E02F 9/2292; E02F 9/2296

USPC ..... 701/50

See application file for complete search history.

(56) References Cited

U.S. PATENT DOCUMENTS

| | | | | |
|---|---|---|---|---|
| 11,506,159 | B1 * | 11/2022 | Rillie, Jr. | F02M 37/103 |
| 11,889,790 | B1 * | 2/2024 | Dougherty | A01D 69/03 |
| 2022/0098833 | A1 * | 3/2022 | Fukuda | E02F 9/2012 |

FOREIGN PATENT DOCUMENTS

| | | | |
|---|---|---|---|
| CN | 113924397 | * | 1/2022 |
| EP | 4012116 | * | 6/2022 |
| JP | 06-082164 U | * | 11/1994 |
| JP | 2910355 B2 | | 6/1999 |
| JP | 5344117 B2 | | 11/2013 |
| JP | 2022-046978 A | | 3/2022 |
| JP | 2022-057494 A | | 4/2022 |

* cited by examiner

*Primary Examiner* — Muhammad Shafi
(74) *Attorney, Agent, or Firm* — Keating & Bennett, LLP

(57) ABSTRACT

A working machine includes a machine body, a working device provided on the machine body movably up and down with respect to the machine body, a protector provided on the machine body to protect an operator's seat on the machine body, a detector provided on the protector to detect an obstacle higher than the protector, and a controller configured or programmed to, when the detector detects the obstacle, perform at least one process to prevent the working device from contacting the obstacle.

6 Claims, 8 Drawing Sheets

WORKING MACHINE

BACKGROUND OF THE INVENTION

1. Field of the Invention

The present invention relates to working machines such as a skid steer loader and a compact track loader. Especially, the present invention relates to working machines each equipped with a system to prevent a working device from contacting an obstacle.

2. Description of the Related Art

There is a known working machine called a "compact track loader" such as disclosed in JP 2022-57494 A. The working machine includes a pair of right and left lift arms swingable up and down with respect to a machine body. An attachment such as a bucket can be attached to tips of the right and left lift arms. A hydraulic fluid port (an auxiliary (AUX) port) is provided on one of the right and left lift arms for use when an attachment, e.g., a sweeper, including a hydraulic actuator is attached to the lift arms.

There are also known working machines such as disclosed in JP 5344117 B2, JP 2022-46978 A, JP 2910355 B2, and JP H6-82164 U, each equipped with a working device including a boom or the like swingable up and down with respect to a machine body. These working machines are each equipped with a detector including an ultrasonic sensor or the like to prevent the working device from interfering with an obstacle or a person.

In a case where the working machine of JP 2022-57494 A with a pallet fork as an attachment attached to the lift arms lifts loads in a room, the AUX port projecting from one of the lift arms may collide with a ceiling when the lift arms are swung upward. To prevent the collision, it is desired that the working machine is provided with a detector capable of detecting the ceiling or the like above the working machine as an obstacle and a process to prevent the working device from interfering with the obstacle is performed based on the detection of the obstacle.

JP 5344117 B2 and JP 2022-46978 A each disclose a technique to prevent the working device from interfering with an obstacle above the working machine when the boom is swung upward. However, the ultrasonic sensor of JP 5344117 B2 is used to detect the boom when swung upward and it is not used to detect obstacles above the working machine. An attitude detector used in JP 2022-46978 A is a potentiometer to measure boom angle or an image sensor to capture an image of the working device. The attitude detection sensor in JP 2022-46978 A is not to detect an obstacle above the working machine, and height limits stored in a memory are used.

In JP 2910355 B2, and JP H6-82164 U, a detector is used to detect obstacles. However, the detector of JP 2910355 B2 detects whether or not an obstacle (or a person) exists in a rotating range of the working device in a surrounding area of the working machine horizontal to the working machine when the working device rotates together with a swiveling base defining or functioning as the machine body, and does not detect obstacles above the working machine. JP H6-82164 U discloses a manner in which the ultrasonic sensor provided on the machine body (or a hood) sideward of a cabin detects objects thereabove. However, the ultrasonic sensor of JP H6-82164 U may not be able to detect, for example, an obstacle above the cabin because the ultrasonic sensor is considerably lower than the top of the cabin. There seem to be many such blind spots.

SUMMARY OF THE INVENTION

Preferred embodiments of the present invention provide working machines each equipped with a detector to detect obstacles and configured to perform a process to prevent the contact of the working device with the obstacles based on the detection of the obstacles.

In a first aspect of a preferred embodiment of the present invention, a working machine includes a machine body, a working device provided on the machine body movably up and down with respect to the machine body, a protector provided on the machine body to protect an operator's seat on the machine body, a detector provided on the protector to detect an obstacle higher than the protector, and a controller configured or programmed to, when the detector detects the obstacle, perform at least one process to prevent the working device from contacting the obstacle.

The at least one process may include a process to reduce a movement speed of the working device as the working device approaches the obstacle.

The working machine may further include a notifier. The at least one process may include a process to cause the notifier to notify an operator seated on the operator's seat of at least presence of the obstacle.

The notifier may include an indicator to indicate a position of the working device and a position of the obstacle detected by the detector.

The working machine may further include a traveling device provided on the machine body. The at least one process may include a process to slow or stop the traveling device.

The working machine may further include an attachment attached to the working device. The controller may be configured or programmed to determine, based on a type of the attachment attached to the working device, whether to cause the detector to perform obstacle detection.

The working machine may further include a memory to store a list of a plurality of types of attachments and pieces of information regarding whether to cause the detector to perform obstacle detection that correspond to the respective plurality of types of attachments, and a selector located near the operator's seat and operable by an operator seated on the operator's seat to select a type of attachment which is one of the plurality of types of attachments stored in the memory. The controller may be configured or programmed to determine, based on the type of attachment selected using the selector, whether to cause the detector to perform the obstacle detection.

An attachment attached to the working device may include a memory to store information regarding whether to cause the detector to perform obstacle detection and that corresponds to a type of the attachment, and may include a communication function to transmit a signal corresponding to the information. The controller may be configured or programmed to receive the signal transmitted from the attachment attached to the working device and determine whether to cause the detector to perform the obstacle detection.

In a second aspect of a preferred embodiment of the present invention, a working machine includes a machine body, a working device provided on the machine body movably up and down with respect to the machine body, the working device including a hydraulic fluid port to allow hydraulic fluid to be supplied from the working device to an attachment attached to the working device, a protector provided on the machine body to protect an operator's seat on the machine body, a detector provided on the working device and adjacent to the hydraulic fluid port to detect an obstacle higher than the protector, and a controller configured or programmed to, when the detector detects the obstacle, perform at least one process to prevent the working device from contacting the obstacle.

The detector may be configured to not perform sensing when the working device is at or below a predetermined position in a direction of movement thereof with respect to the machine body.

The at least one process may include a process to reduce a movement speed of the working device as the working device approaches the obstacle.

The working machine may further include a notifier. The at least one process may include a process to cause the notifier to notify an operator seated on the operator's seat of at least presence of the obstacle.

The notifier may include an indicator to indicate a position of the working device and a position of the obstacle detected by the detector.

The working machine may further include a traveling device provided on the machine body. The at least one process may include a process to slow or stop the traveling device.

The working machine may include an attachment attached to the working device. The controller may be configured or programmed to determine, based on a type of the attachment attached to the working device, whether to cause the detector to perform obstacle detection.

The working machine may further include a memory to store a list of a plurality of types of attachments and pieces of information regarding whether to cause the detector to perform obstacle detection that correspond to the respective plurality of types of attachments, and a selector located near the operator's seat and operable by an operator seated on the operator's seat to select a type of attachment which is one of the plurality of types of attachments stored in the memory. The controller may be configured or programmed to determine, based on the type of attachment selected using the selector, whether to cause the detector to perform the obstacle detection.

An attachment attached to the working device may include a memory to store information regarding whether to cause the detector to perform obstacle detection and that corresponds to a type of the attachment, and may include a communication function to transmit a signal corresponding to the information. The controller may be configured or programmed to receive the signal transmitted from the attachment attached to the working device and determine whether to cause the detector to perform the obstacle detection.

In a third aspect of a preferred embodiment of the present invention, a working machine includes a machine body, a working device provided on the machine body movably up and down with respect to the machine body, a protector provided on the machine body to protect an operator's seat on the machine body, a first detector provided on the protector to detect a first obstacle higher than the protector, a second detector provided on the working device to detect a second obstacle higher than the protector when the working device is above a predetermined position in a direction of movement thereof with respect to the machine body, and a controller configured or programmed to, when the first detector and/or the second detector detect or detects the first obstacle or the second obstacle, perform at least one process to prevent the working device from contacting the first obstacle or the second obstacle.

When the working device is at or below the predetermined position, the first detector may perform sensing and the second detector may not perform sensing to allow the first obstacle to be detected by the first detector, and when the working device is above the predetermined position, the first detector may not perform sensing and the second detector may perform sensing to allow the second obstacle to be detected by the second detector.

The first detector and the second detector may each include an ultrasonic sensor. The first detector may be positioned such that a direction of transmission of ultrasonic waves from the first detector is an upward direction. The second detector may be positioned such that a direction of transmission of ultrasonic waves from the second detector approaches an upward direction as the working device moves upward from the predetermined position and approaches a horizontal direction as the working device moves downward from the predetermined position.

The working machine may include an attachment attached to the working device. The controller may be configured or programmed to determine, based on a type of the attachment attached to the working device, whether to cause the first detector and/or the second detector to perform obstacle detection.

The working machine may further include a memory to store a list of a plurality of types of attachments and pieces of information regarding whether to cause the first detector and/or the second detector to perform obstacle detection that correspond to the respective plurality of types of attachments, and a selector located near the operator's seat and operable by an operator seated on the operator's seat to select a type of attachment which is one of the plurality of types of attachments stored in the memory. The controller may be configured or programmed to determine, based on the type of attachment selected using the selector, whether to cause the first detector and/or the second detector to perform the obstacle detection.

An attachment attached to the working device may include a memory to store information that is regarding whether to cause the first detector and/or the second detector to perform obstacle detection and that corresponds to a type of the attachment, and may include a communication function to transmit a signal corresponding to the information. The controller may be configured or programmed to receive the signal transmitted from the attachment attached to the working device and determine whether to cause the first detector and/or the second detector to perform the obstacle detection.

The at least one process may include a process to reduce a movement speed of the working device as the working device approaches the first obstacle or the second obstacle.

The working machine may further include a notifier. The at least one process may include a process to cause the notifier to notify an operator seated on the operator's seat of at least presence of the first obstacle or the second obstacle.

The notifier may include an indicator to indicate a position of the working device and a position of the first obstacle or the second obstacle detected by the first and second detectors.

The working machine may further include a traveling device provided on the machine body. The at least one process may include a process to slow or stop the traveling device.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
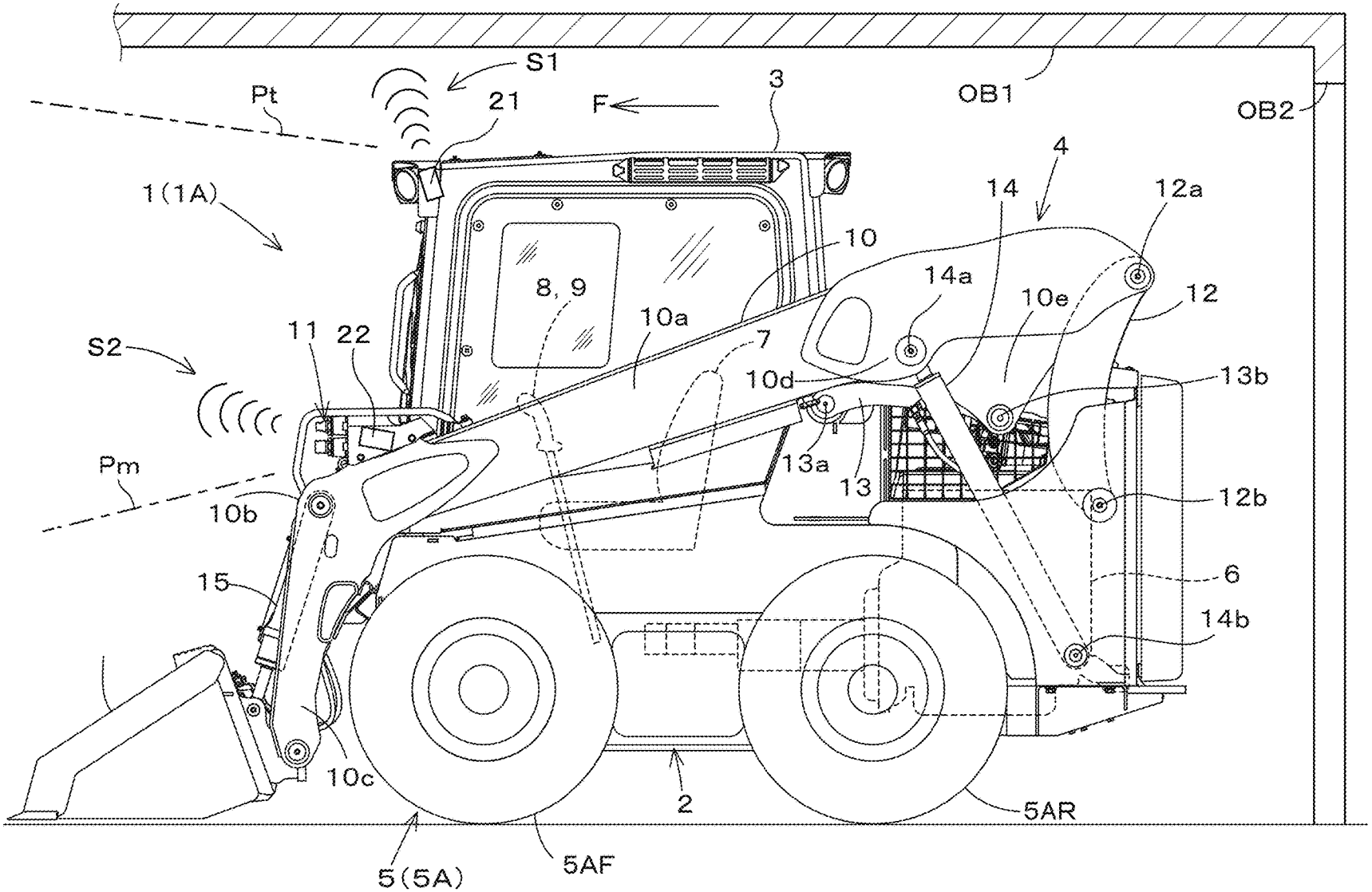
FIG. 1 is a side view of a working machine according to a first preferred embodiment of the present invention.

The preferred embodiments will now be described with reference to the accompanying drawings, wherein like reference numerals designate corresponding or identical elements throughout the various drawings. The drawings are to be viewed in an orientation in which the reference numerals are viewed correctly.

Figure 2:
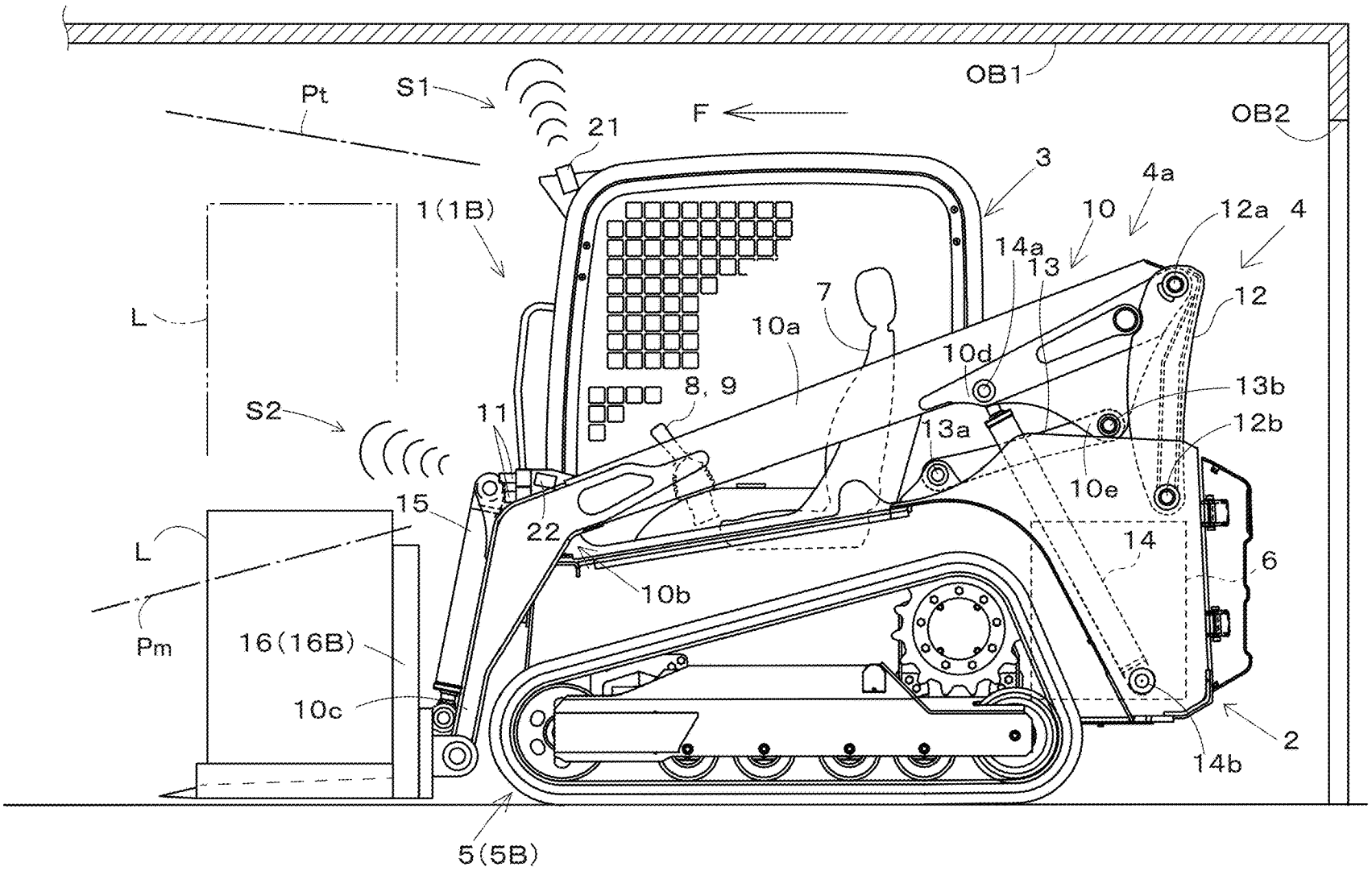
FIG. 2 is a side view of a working machine according to a second preferred embodiment of the present invention.

Referring to FIGS. 1 and 2, a general configuration of a working machine 1 will be outlined. Examples of the working machine 1 include skid steer loaders, compact track loaders, tractors and so on. FIG. 1 illustrates a working machine 1A, which is a skid steer loader, as an example of the working machine 1. FIG. 2 illustrates a working machine 1B, which is a compact track loader, as another example of the working machine 1. The following discusses a configuration of the working machine 1 representative of the working machines 1A and 1B.

The working machine 1 includes a machine body 2, a cabin 3, a working device 4 and a traveling device 5. The cabin 3, the working device 4, and the traveling device 5 are provided on the machine body 2. The "forward direction" in the following description refers to the direction indicated by arrow F in FIGS. 1 and 2, and the "rearward direction" in the following description refers to the direction opposite to the direction indicated by arrow F. The "right" in the following description refers to the right of the working machine 1 when the operator (user) of the working machine 1 is facing in the forward direction (direction indicated by arrow F). The "left" in the following description refers to the left of the working machine 1 when the operator (user) of the working machine 1 is facing in the forward direction (direction indicated by arrow F).

The working machine 1A of FIG. 1 is a skid steer loader (SSL) whose traveling device 5 is a wheeled traveling device 5A including a pair of right and left front wheels 5AF and a pair of right and left rear wheels 5AR. The working machine 1B of FIG. 2 is a compact track loader (CTL) whose traveling device 5 is a crawler traveling device 5B.

A prime mover 6 is mounted on a rear portion of the machine body 2 rearward of the cabin 3. The prime mover 6 is an internal combustion engine such as a diesel engine or a gasoline engine. Alternatively, the prime mover 6 may include an internal combustion engine and/or an electric motor, for example. The prime mover 6 drives hydraulic pumps 32R and 32L in a traveling hydraulic system 30 of FIG. 3 and hydraulic pumps 41 and 42 in a working hydraulic system 40 of FIG. 4.

An operator's seat 7 is mounted on the machine body 2. The cabin 3 is mounted on the machine body 2 to enclose the operator's seat 7. The cabin 3 is a kind of protector to protect an operator seated on the operator's seat 7, meters and manipulators such as levers and switches arranged around the operator's seat, and/or the like. Another protector having such a function, such as a canopy or a rollover protective structure (ROPS), may be mounted on the machine body 2.

Referring to FIGS. 1 and 2, the manipulators to be manually operated by an operator seated on the operator's seat 7 in the cabin 3 include a lever (such as a joystick) 8 (hereinafter referred to as "traveling operation lever 8") operable to change the traveling direction and travel speed of the traveling device 5, and a lever (such as a joystick) 9 (hereinafter referred to as "working operation lever 9") operable to swing (move) lift arms 10 of the working device 4 up and down (raise and lower the lift arms 10) and/or swing an attachment 16 attached to the working device up and down (raise and lower the attachment 16). The traveling operation lever 8 and the working operation lever 9 are located on the right and left sides of a front portion of the operator's seat 7.

Figure 3:
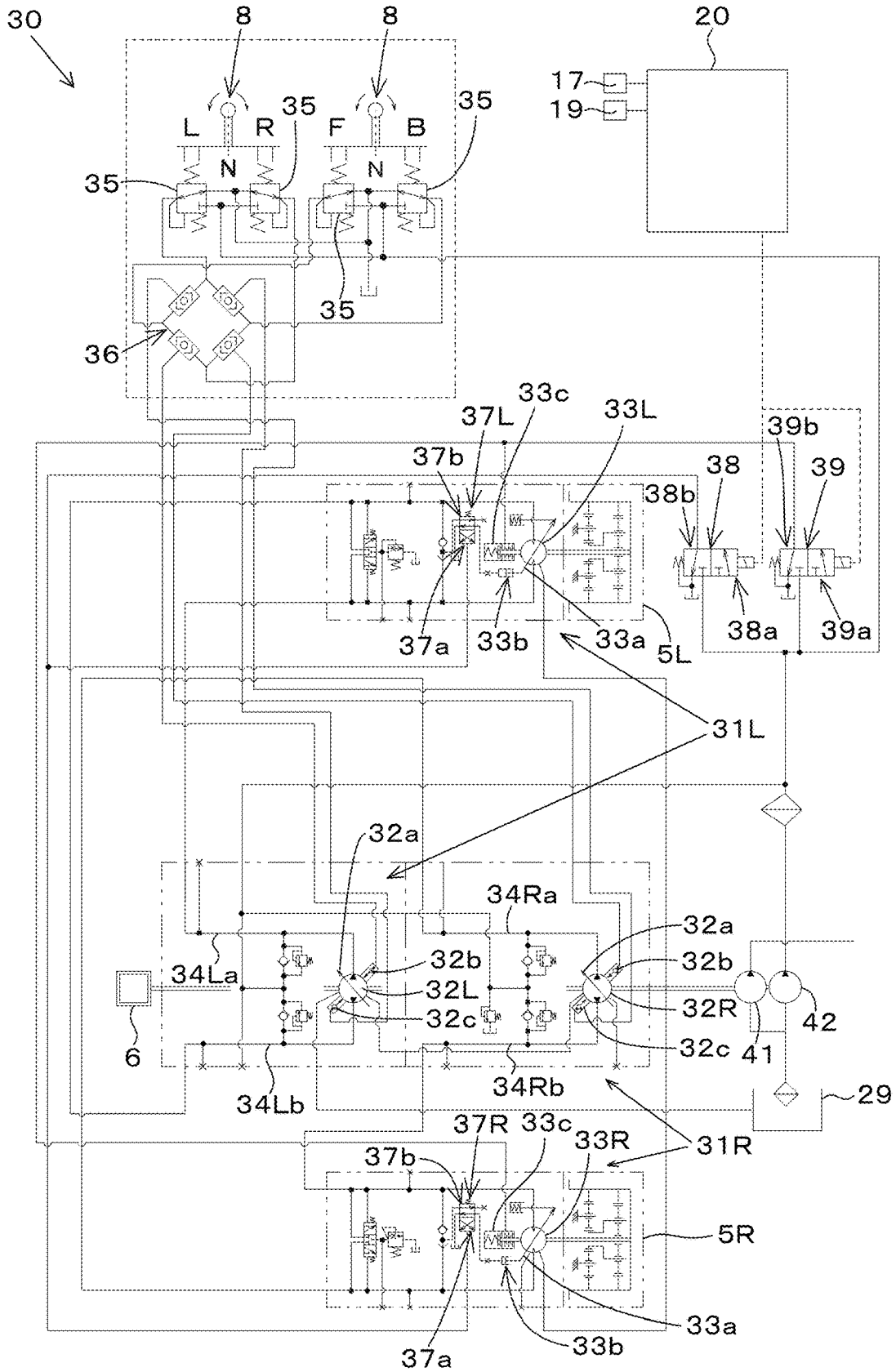
FIG. 3 is a circuit diagram of a traveling hydraulic system for a working machine according to a preferred embodiment of the present invention.
Figure 4:
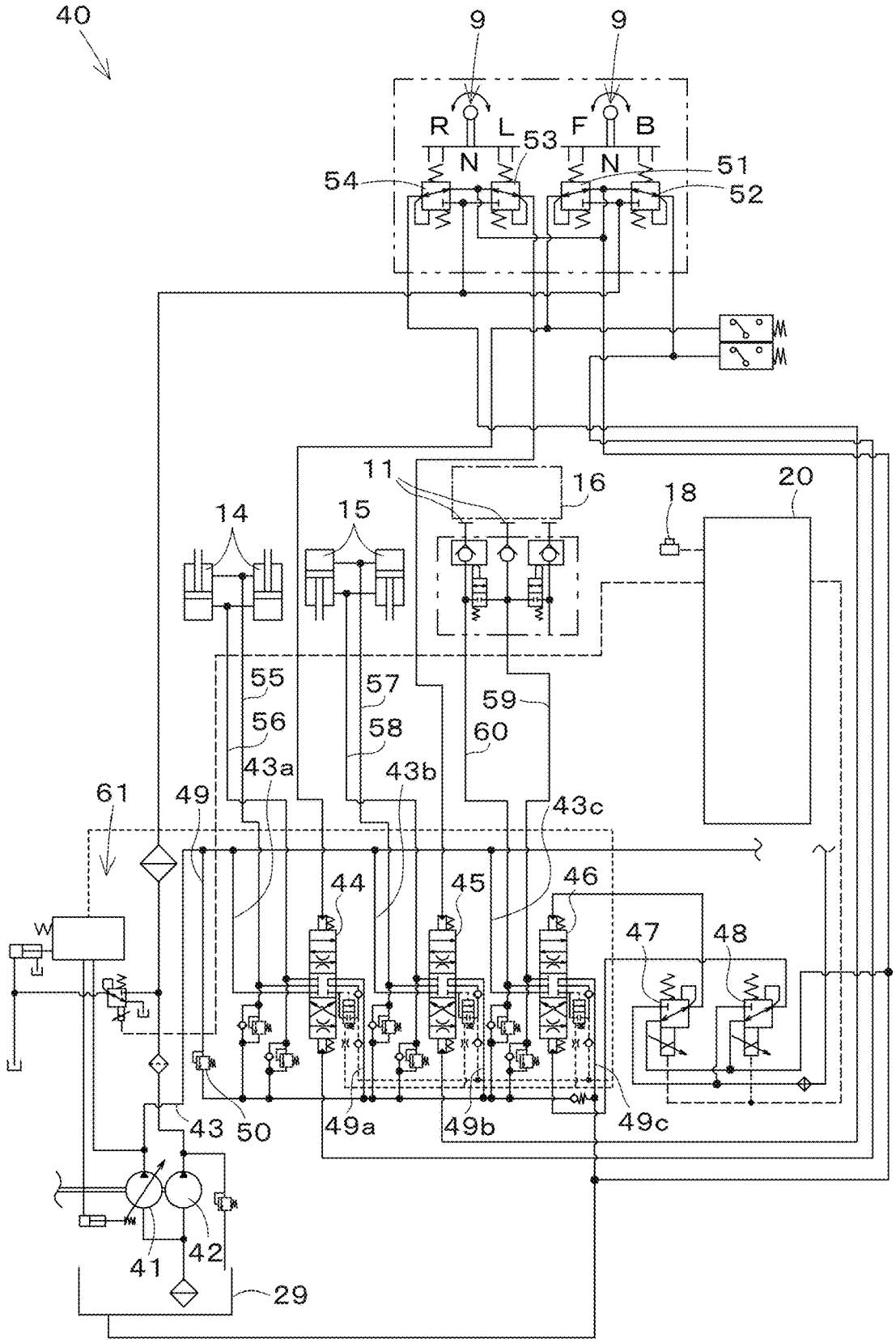
FIG. 4 is a circuit diagram of a working hydraulic system for a working machine according to a preferred embodiment of the present invention.

The manipulators to be manually operated by an operator seated on the operator's seat 7 in the cabin 3 also include a speed shift switch 17, an attachment driving switch (AUX switch) 18 and a brake pedal 19 that are not illustrated in FIG. 1 or 2. Referring to FIG. 3, the speed shift switch 17, operable to change the traveling speed stage of the traveling device 5 between high and low speed stages, is adjacent to the operator's seat 7 (for example, on the traveling operation lever 8). Referring to FIG. 4, the attachment driving switch (AUX switch) 18, operable to control fluid supply to a hydraulic actuator when a work attachment including the hydraulic actuator is attached to the working device 4, is adjacent to the operator's seat 7 (for example, on the working operation lever 9). Referring to FIG. 3, the brake pedal 19 is located at a position at which a foot of an operator seated on the operator's seat 7 is placed in the cabin 3.

The working device 4 includes the right and left lift arms 10 attached to the machine body 2 swingably up and down with respect to the machine body 2. The right lift arm 10 is on the right side of the cabin 3. The left lift arm 10 is on the left side of the cabin 3. Each left arm 10 extends lengthwise in the fore-and-aft direction of the working machine 1.

Front portions of the right and left lift arms 10 are joined to each other via a connection member (not illustrated) in front of the cabin 3. Rear portions of the right and left lift arms 10 are joined to each other via a connection member (not illustrated) behind the cabin 3. An assembly of the right and left lift arms 10 and the front and rear connection members (not illustrated) assembled in this way, defining and functioning as a main body 4*a* of the working device 4, is attached to the machine body 2 swingably up and down with respect to the machine body.

The manner in which the right and left lift arms 10 are joined to each other is not limited to using the front and rear connection members as described above. The right and left lift arms 10 may be joined to each other in any manner, provided that the right and left lift arms 10 are swingable together up and down with respect to the machine body 2.

Each of the lift arms 10 includes a main arm portion 10*a* extending in the fore-and-aft direction, a bent portion 10*b* provided at a front end of the main arm portion 10*a*, and a tip arm portion 10*c* extending diagonally forward and downward from the bent portion 10*b*.

The working device 4 includes right and left lift links 12 and right and left control links 13 to support the right and left lift arms 10 at a rear portion of the main body 2. The working device 4 includes right and left lift arm cylinders 14 as hydraulic actuators to swing the right and left lift arms 10 up and down with respect to the machine body 2.

FIGS. 1 and 2, each of which is a left side view of the working machine 1, illustrate the left lift arm 10, the left lift link 12, the left control link 13, and the left lift arm cylinder 14 which are located leftward of the cabin 3. The right lift arm 10, the right lift link 12, the right control link 13, and the right lift arm cylinder 14 are located rightward of the cabin 3 in a similar manner, but they are not illustrated in FIG. 1 or 2.

FIGS. 1 and 2 illustrate the main body 4*a* of the working machine 4 including the right and left lift arms 10 in its fully lowered position Pm in the direction (or range) of up-and-down movement thereof with respect to the machine body 2. Hereinafter, the position of the main body 4*a* of the working device 4 including the right and left lift arms 10 in the direction of the up-and-down movement (swinging movement) with respect to the machine body 2 may be simply referred to as an "arm height". The positions and directions of elements and portions of the working device 4 will be described on the assumption that the main body 4*a* of the working machine 4 including the right and left lift arms 10 is in the fully lowered position Pm, i.e., the arm height is minimum.

Each of the lift links 12 extends substantially vertically, is pivotally connected at a top end thereof to a rear end of the main arm portion 10*a* of a corresponding lift arm 10 via a corresponding pivot 12*a*, and is pivotally connected at a bottom end thereof to an upper rear portion of the machine body 2 via a corresponding pivot 12*b*. At a position forward of the lift link 12, the main arm portion 10*a* of the lift arm 10 is provided at a rear portion thereof with a bracket 10*d*, and a head of a piston rod of a corresponding lift arm cylinder 14 is pivotally connected to the bracket 10*d* via a corresponding pivot 14*a*. The bottom end of the lift arm cylinder 14 is pivotally connected to a lower rear portion of the main body 2 via a corresponding pivot 14*b*.

Each of the lift arm cylinders 14 includes a piston that is not illustrated in FIG. 1 or 2. The piston is moved by hydraulic pressure to extend or retract the piston rod. In each of FIGS. 1 and 2, the lift arm cylinders 14 have the piston rods in their fully retracted position. In other words, the lift arms 10 are in the fully lowered position Pm when the lift arm cylinders 14 are in the fully retracted position.

The main arm portion 10*a* of each of the lift arms 10 is provided with a downwardly projecting bracket 10*e* that is located forward of the rear end of the main arm portion 10*a*. Each of the control links 13 extends substantially in the fore-and-aft direction, is pivotally connected at a front end thereof to an upper rear portion of the main body 2 via a corresponding pivot 13*a*, and is pivotally connected at a rear end thereof to a corresponding bracket 10*e* via a corresponding pivot 13*b*, when the lift arms 10 are in the fully lowered position Pm. The pivots 12*a*, 13*b* and 14*a* are arranged triangularly when seen in a side view.

The main arm portions 10*a* of the lift arms 10 extend forward (diagonally forward and downward when the lift arms 10 are in the fully lowered position Pm) from the respective brackets 10*d*. The bent portions 10*b* define the front ends of the main arm portions 10*a* in front of the cabin 3. The tip arm portions 10*c* extend diagonally forward and downward from the respective bent portions 10*b*. The tip arm portions 10*c* include lower front ends to be pivotally connected to the attachment 16 for work.

The working device 4 includes right and left attachment cylinders 15. The right and left attachment cylinders 15 are hydraulic actuators to support the attachment 16 attached to the tip arm portions 10*c* of the right and left lift arms 10 and swing the attachment 16 up and down with respect to the lift arms 10.

Each of the attachment cylinders 15 is pivotally connected to the bent portion 10*b* of a corresponding lift arm 10 at an upper end thereof (cylinder bottom thereof), and is pivotally connected at a lower end thereof (tip of the piston rod thereof) to the attachment 16 attached to the tip arm portions 10*c* of the lift arms 10.

The attachment 16 is pivotally connected at a rear portion thereof to the lower front portions of the tip arm portions 10*c* of the right and left lift arms 10 and to the tips of the piston rods of the attachment cylinders in this way, so that the attachment 16 is attached to the main body 4*a* of the working device 4 swingably up and down with respect to the working device 4 (lift arms 10).

The working device 4 is configured to have various kinds of attachments 16 attached thereto in this way. Examples of the various kinds of attachments 16 include brackets, dozer blades, brushcutters, tree-pullers, hydraulic crushers, hydraulic breakers, angle brooms, earth augers, pallet forks, sweepers, mowers, snowblowers and so on. FIG. 1 illustrates a preferred embodiment in which an attachment 16A in the form of a bucket is attached to the working device 4 of the working machine 1. FIG. 2 illustrates another preferred embodiment in which an attachment 16B in the form of a pallet fork is attached to the working device 4 of the working machine 1.

One of the right and left lift arms 10 (in the present preferred embodiment, the left lift arm 10) has, on the bent portion 10*b* thereof, one or more AUX ports (one or more hydraulic fluid ports) 11. The AUX ports 11 are couplers and project from the corresponding lift arm 10. The AUX ports (couplers) 11 can have connected thereto fluid pipes such as hoses, which are connectable at their ends to a hydraulic actuator (AUX actuator) of the attachment 16 attached to the front ends of the right and left lift arms 10. It is noted that each of the attachments 16A and 16B illustrated in FIGS. 1 and 2 includes no such hydraulic actuators, and therefore no such fluid pipes are connected to the AUX ports 11 in FIGS. 1 and 2.

The following description discusses up-and-down movement (raising and lowering movements) of the lift arms 10 (the main body 4*a* of the working device 4). Upon upward extension of the piston rods of the right and left lift arm cylinders 14 from the state of FIGS. 1 and 2 in which the right and left lift arms 10 are in the fully lowered position Pm, the piston rods raise the brackets 10*d* of the lift arms 10, so that the main body 4*a* of the working device 4 including the lift arms 10 swing such that the angle between the main arms 10*a* of the lift arms 10 and the lift arms 12 increases. Accordingly, the control links 13 swing diagonally forward and upward and front portions (the bent portions 10*b* and the tip arm portions 10*c*) of the lift arms 10 move upward.

When the ends of the control links 13 pivotally connected to the brackets 10*e* of the lift arms 10 are moved by swinging the control links 13 diagonally forward and upward and reach their highest position in the range of the up-and-down movement, the right and left lift arms 10 of the main body 4*a* of the working device 4 can no longer be raised upward. In other words, when the ends of the control links 13 pivotally connected to the lift arms 10 reach this highest position, the right and left lift arms 10 of the main body 4*a* of the working device 4 reach their fully raised position, i.e., the arm height reaches the maximum, and the lift arm cylinders 14 are in their fully extended position.

The working machine 1 (including the working machines 1A and 1B) includes a traveling hydraulic system 30 shown in FIG. 3 and a working hydraulic system 40 shown in FIG. 4. These systems will be described.

The following description first discusses the traveling hydraulic system 30 to control drive of the traveling device 5 with reference to the hydraulic circuit diagram of FIG. 3. It is assumed here that the traveling device 5 (including the traveling devices 5A and 5B) includes a right traveling device 5R on the right portion of the machine body 2 and a left traveling device 5L on the left portion of the machine body 2, which can be driven independently of each other.

The traveling hydraulic system 30 includes hydrostatic stepless transmissions (HSTs) 31R and 31L provided on the machine body 2. The HST 31R includes a hydraulic pump 32R, a hydraulic motor 33R, and a pair of fluid passages 34Ra and 34Rb interposed between the hydraulic pump 32R and the hydraulic motor 33R. The HST 31L includes a hydraulic pump 32L, a hydraulic motor 33L, and a pair of fluid passages 34La and 34Lb interposed between the hydraulic pump 32L and the hydraulic motor 33L.

The hydraulic pumps 32R and 32L are drivingly connected to an output shaft 6*a* of the prime mover 6 to be rotated together synchronously with the output rotation of the prime mover 6. The hydraulic motor 33R is drivingly connected to the right traveling device 512. The hydraulic motor 33L is drivingly connected to the left traveling device 5L.

The hydraulic pumps 32R and 32L are variable displacement hydraulic pumps including respective movable swash plates 32*a*. Each of the hydraulic pumps 32R and 32L includes a pair of pressure receivers 32*b* and 32*c*. The tilt direction and angle of the movable swash plate 32*a* is controlled by applying pilot fluid pressure to the pressure receivers 32*b* and 32*c*.

Hydraulic pumps 41 and 42 are drivingly connected to the output shaft 6*a* of the prime mover 6. The hydraulic pump 42 is driven by the prime mover 6 to suck fluid from a reservoir tank 29 and deliver the fluid. A portion of fluid delivered by the hydraulic pump 42 is supplied to the HSTs 31R and 31L.

Another portion of the fluid delivered from the hydraulic pump 42 may flow through pump control valves 35 operably connected to the traveling operation lever 8 and through shuttle valves 36 to be applied as pilot pressure fluid to the pressure receivers 32*b* and 32*c* of the hydraulic pumps 32R and 32L to control the movable swash plates 32*a*.

When the traveling operation lever 8 is in a neutral position N, the movable swash plates 32*a* of the hydraulic pumps 32R and 32L are in their neutral position and therefore neither the hydraulic pump 32R nor the hydraulic pump 32L delivers fluid, rotating neither the hydraulic motor 33R nor the hydraulic motor 33L. Therefore, the right and left traveling devices 512 and 5L are in their stopped state and therefore the working machine 1 (the machine body 2) is in its stopped state.

When the traveling operation lever 8 is tilted forward (F) from the neutral position N, the movable swash plates 32*a* of the hydraulic pumps 32R and 32L each tilt in a direction for forward traveling from the neutral position, so that the right and left hydraulic pumps 32R and 32L deliver fluid in a direction to rotate the hydraulic motors 33R and 33L normally. It follows that the right traveling device 512 and the left traveling device 5L are driven to achieve forward travel, causing the working machine 1 (the machine body 2) to travel straight forward. As the forward tilt angle of the traveling operation lever 8 increases, the tilt angle of the movable swash plates 32*a* of the hydraulic pumps 32R and 32L increases and therefore the speed of normal rotation of the hydraulic motors 33R and 33L increases, so that the speed of forward travel of the right traveling device 512 and the speed of forward travel of the left traveling device 5L increase synchronously with each other and the speed of straight forward travel of the working machine 1 (the machine body 2) increases.

When the traveling operation lever 8 is tilted rearward (B) from the neutral position N, the movable swash plates 32*a* of the hydraulic pumps 32R and 32L each tilt in a direction for backward traveling from the neutral position, so that the right and left hydraulic pumps 32R and 32L deliver fluid in a direction to reversely rotate the hydraulic motors 33R and 33L. It follows that the right traveling device 5R and the left traveling device 5L are driven to achieve backward travel, causing the working machine 1 (the machine body 2) to travel straight backward. As the backward tilt angle of the traveling operation lever 8 increases, the tilt angle of the movable swash plates 32*a* of the hydraulic pumps 32R and 32L increase and therefore the speed of reverse rotation of the hydraulic motors 33R and 33L increases, so that the speed of backward travel of the right traveling device 5R and the speed of backward travel of the left traveling device 5L increase synchronously with each other and the speed of straight backward travel of the working machine 1 (the machine body 2) increases.

When the traveling operation lever 8 is tilted rightward (R) from the neutral position N, the movable swash plate 32*a* of the hydraulic pump 32R tilts in the direction for backward traveling from the neutral position and the movable swash plate 32*a* of the hydraulic pump 32L tilts in the direction for forward traveling from the neutral position, so that the right hydraulic pump 32R delivers fluid in the direction to reversely rotate the hydraulic motor 33R and the left hydraulic pump 32L delivers fluid in the direction to rotate the hydraulic motor 33L normally. It follows that the right traveling device 5R is driven to achieve backward travel and the left traveling device 5L is driven to achieve forward travel, causing the working machine 1 (the machine body 2) to make a right pivot turn. As the rightward tilt angle of the traveling operation lever 8 increases, the speed of backward travel speed of the right traveling device 5R and the speed of forward travel of the left traveling device 5L increase and the speed of right turning of the working machine 1 (machine body 2) increases.

It is noted that, when the traveling operation lever 8 is tilted exactly rightward (R) from the neutral position N, the speed of backward travel speed of the right traveling device 5R and the speed of forward travel of the left traveling device 5L are equal to each other, causing the working machine 1 to make a spin turn. When the traveling operation lever 8 is tilted diagonally rightward and forward or diagonally rightward and backward from the neutral position N, the speed of backward travel of the right traveling device 5R and the speed of forward travel of the left traveling device 5L are varied from each other according to the degree of forward or backward tilting of the traveling operation lever 8, causing the working machine 1 to make a pivot turn with a turning radius corresponding to the difference in speed between the right and left traveling devices 5R and 5L.

When the traveling operation lever 8 is tilted leftward (L) from the neutral position N, the movable swash plate 32*a* of the hydraulic pump 32L tilts in the direction for backward traveling from the neutral position and the movable swash plate 32*a* of the hydraulic pump 32R tilts in the direction for forward traveling from the neutral position, so that the left hydraulic pump 32L delivers fluid in the direction to reversely rotate the hydraulic motor 33L and the right hydraulic pump 32R delivers fluid in the direction to rotate the hydraulic motor 33R normally. It follows that the left traveling device 5L is driven to achieve backward travel and the right traveling device 5R is driven to achieve forward travel, causing the working machine 1 (the machine body 2) to make a left pivot turn. As the leftward tilt angle of the traveling operation lever 8 increases, the speed of backward travel of the left traveling device 5L and the speed of forward travel of the right traveling device 5R increase and the speed of left turning of the working machine 1 (machine body 2) increases.

It is noted that, when the traveling operation lever 8 is tilted exactly leftward (L) from the neutral position N, the speed of backward travel of the left traveling device 5L and the speed of forward travel of the right traveling device 5R are equal to each other, causing the working machine 1 to make a spin turn. When the traveling operation lever 8 is tilted diagonally leftward and forward or diagonally leftward and backward from the neutral position N, the speed of backward travel of the left traveling device 5L and the speed of forward travel of the right traveling device 5R are varied from each other according to the degree of forward or backward tilting of the traveling operation lever 8, causing the working machine 1 to make a pivot turn with a turning radius corresponding to the difference in speed between the right traveling device 5R and the left traveling device 5L.

The hydraulic motors 33R and 33L are variable displacement hydraulic motors including respective movable swash plates 33*a*. Each of the movable swash plates 33*a* is shiftable between a tilt position for high speed travel (hereinafter referred to as "high-speed tilt position") (a small angled position, or a position for small displacement) and a tilt position for low speed travel (hereinafter referred to as "low-speed tilt position") (a large angled position, or a position for large displacement). The movable swash plates 33*a* are each biased to the high-speed tilt position.

Each of the hydraulic motors 33R and 33L includes a swash plate control actuator 33*b* defining and functioning as a hydraulic cylinder operably connected to a corresponding movable swash plate 33*a*. The swash plate control actuator 33*b* of the hydraulic motor 33R is fluidly connected to a switching valve 37R. The swash plate control actuator 33*b* of the hydraulic motor 33L is fluidly connected to a switching valve 37L.

Each of the switching valves 37R and 37L is shiftable between a fluid supply position 37*a* to allow fluid to be supplied to a corresponding swash plate control actuator 33*b* and a fluid discharge position 37*b* to allow fluid to be discharged from the corresponding swash plate control actuator 33*b*. The switching valve 37R in in its fluid supply position 37*a* allows fluid to be supplied to its corresponding swash plate control actuator 33*b* from one of the fluid passages 34Ra and 34Rb of the HST 31R that has a higher pressure than the other. The switching valve 37L in its fluid supply position 37*a* allows fluid to be supplied to its corresponding swash plate control actuator 33*b* from one of the fluid passages 34La and 34Lb of the HST 31L that has a higher pressure than the other.

The swash plate control actuator 33*b*, when supplied with fluid from a corresponding switching valve 37R or 37L, tilts a corresponding movable swash plate 33*a* to the low-speed tilt position against the biasing force. The swash plate control actuator 33*b*, upon discharging fluid to the corresponding switching valve 37R or 37L, allows the corresponding movable swash plate 33*a* to return to the high-speed tilt position under the biasing force. In this way, each of the movable swash plates 33*a* is shifted between the two tilt positions by shifting a corresponding switching valve 37R or 37L between the two positions.

Each of the switching valves 37R and 37L is shifted to either of the two positions depending on whether or not the switching valve 37R or 37L receives pilot fluid pressure. Each of the switching valves 37R and 37L is in the fluid supply position 37*a* when receiving the pilot fluid pressure, and returns to the fluid discharge position 37*b* under the biasing force when the pilot fluid pressure is removed. The fluid delivered from the hydraulic pump 42 can be supplied as pilot pressure fluid to the switching valves 37R and 37L via a speed-shift solenoid switching valve 38.

The speed-shift solenoid switching valve 38 is shiftable between an open position 38*a* and a closed position 38*b* and is biased to the closed position 38*b*. The speed-shift solenoid switching valve 38, when in the closed position 38*b*, isolates the fluid delivered by the hydraulic pump 42 from the pressure receivers of the switching valves 37R and 37L, bringing the switching valves 37R and 37L into their fluid discharge position 37*b*.

The traveling hydraulic system 30 includes a controller 20 to positionally control the speed-shift solenoid switching valve 38 and a brake solenoid switching valve 39 (which is described later). The controller 20 includes, for example, electric/electronic circuit(s) including a central processing unit (CPU), a microprocessor unit (MPU), a memory, and/or the like.

In the present preferred embodiment, the controller 20 is used to control the traveling hydraulic system 30 of FIG. 3, the working hydraulic system 40 of FIG. 4, and a working device contact prevention control system 70 of FIG. 5 (which is described later). Note, however, that the systems may be controlled by their respective corresponding controllers and the controllers may communicate with each other.

The speed-shift solenoid switching valve 38 is electrically connected to an output interface of the controller 20. When the speed-shift solenoid switching valve 38 receives a control signal from the controller 20, a solenoid of the speed-shift solenoid switching valve 38 is energized, so that the speed-shift solenoid switching valve 38 is shifted to the open position 38*a*, allowing the fluid delivered from the hydraulic pump 42 to flow therefrom to the switching valves 37R and 37L as pilot pressure fluid. This brings the switching valves 37R and 37L into their fluid supply position 37*a*.

The speed shift switch 17 is electrically connected to an input interface of the controller 20. The speed shift switch 17 is shiftable between a high-speed position and a low-speed position. When the speed shift switch 17 is in the high-speed position, the controller 20 does not output the control signal to energize the solenoid. It follows that the speed-shift solenoid switching valve 38 is in the closed position 38*b*, the switching valves 37R and 37L are in the fluid supply position 37*b*, the movable swash plates 33*a* of the hydraulic motors 33R and 33L are in the high-speed tilt position, and therefore the hydraulic motors 33R and 33L rotate in the high-speed stage.

When the speed shift switch 17 is in the low-speed position, the controller 20 outputs the control signal to energize the solenoid. It follows that the speed-shift solenoid switching valve 38 is in the open position 38*a*, the switching valves 37R and 37L are in the fluid supply position 37*a*, the movable swash plates 33*a* of the hydraulic motors 33R and 33L are in the low-speed tilt positions, and therefore the hydraulic motors 33R and 33L rotate in the low-speed stage.

Each of the hydraulic motors 33R and 33L includes a brake actuator 33*c* defining and functioning as a hydraulic actuator. The brake actuator 33*c*, when supplied with fluid, brakes a corresponding hydraulic motor 33R or 33L. The fluid delivered from the hydraulic pump 42 can be supplied to the brake actuators 33*c* of the hydraulic motors 33R and 33L via the brake solenoid switching valve 39.

The brake solenoid switching valve 39 is shiftable between an open position 39*a* and a closed position 39*b* and is biased to the closed position 39*b*. The brake solenoid switching valve 39, when in the closed position 39*b*, isolates the fluid delivered by the hydraulic pump 42 from the brake actuators 33*c* of the hydraulic motors 33R and 33L.

The brake solenoid switching valve 39 is electrically connected to the output interface of the controller 20. When the brake solenoid switching valve 39 receives a control signal from the controller 20, a solenoid of the brake solenoid switching valve 39 is energized, so that the brake solenoid switching valve 39 is shifted to the open position 39*a*, allowing the fluid delivered from the hydraulic pump 42 to flow therefrom to the brake actuators 33*c*. This brakes the hydraulic motors 33R and 33L.

The brake pedal 19 is electrically connected to the input interface of the controller 20. When the brake pedal 19 is not depressed, the controller 20 does not output the control signal for the energization of the solenoid. It follows that the brake solenoid switching valve 39 is in the closed position 39*b*, and therefore the hydraulic motors 33R and 33L are not braked.

When the brake pedal 19 is depressed to a brake position, the controller 20 outputs the control signal to energize the solenoid. It follows that the brake solenoid switching valve 39 is in in the open position 39*a*, and therefore the hydraulic motors 33R and 33L are braked.

Referring to the hydraulic circuit diagram of FIG. 4, the working hydraulic system 40 will be described. As shown in FIG. 4, the working hydraulic system 40 includes the hydraulic pumps 41 and 42. The hydraulic pumps 41 and 42 are driven together by power from the prime mover 6 to suck fluid from the common reservoir tank 29 and deliver fluid from delivery ports thereof.

The hydraulic pump 41 delivers hydraulic fluid to the hydraulic actuators (including the right and left lift arm cylinders 14 and the right and left attachment cylinders 15) of the working device 4 of the working machine 1 and the hydraulic actuator of the attachment 16 (such as a hydraulic motor of a sweeper to drive a rotary brush) attached to the working device 4.

The machine body 2 is provided with a lift arm control valve 44 to control a flow of hydraulic fluid supplied to the right and left lift arm cylinders 14, an attachment control valve 45 to control a flow of hydraulic fluid supplied to the right and left attachment cylinders 15, and an AUX control valve 46 to control a flow of hydraulic fluid supplied to the AUX ports 11.

A delivery fluid passage 43 extends from a delivery port of the hydraulic pump 41. Supply fluid passages 43*a*, 43*b* and 43*c*, which are parallel to each other and branch from the delivery fluid passage 43, are connected to pump ports of the lift arm control valve 44, the attachment control valve 45, and the AUX control valve 46, respectively.

Each of the lift arm cylinders 14 is a double-acting hydraulic cylinder whose inner space is divided by a piston into a bottom-side (lower) fluid chamber and a rod-side (upper) fluid chamber. Fluid supply/discharge passages 55 and 56 extend from the lift arm control valve 44. The fluid supply/discharge passage 55 is fluidly connected to the rod-side fluid chambers of the right and left lift arm cylinders 14. The fluid supply/discharge passage 56 is fluidly connected to the bottom-side fluid chambers of the right and left lift arm cylinders 14.

Each of the attachment cylinders 15 is a double-acting hydraulic cylinder whose inner space is divided by a piston into a rod-side (lower) fluid chamber and a bottom-side (upper) fluid chamber. Fluid supply/discharge passages 57 and 58 extend from the attachment control valve 45. The fluid supply/discharge passage 57 is fluidly connected to the bottom-side fluid chambers of the right and left attachment cylinders 15. The fluid supply/discharge passage 58 is fluidly connected to the rod-side fluid chambers of the right and left attachment cylinders 15.

Fluid supply/discharge passages 59 and 60 extend from the AUX control valve 46 and are connected to corresponding ones of the AUX ports 11. When the attachment 16 including a hydraulic actuator is attached to tips of the lift arms 10, the hydraulic actuator is fluidly connected to the AUX ports 11.

Each of the control valves 44, 45 and 46 is a pilot-operated directional switching valve including a spool and pressure receivers provided on opposite sides of the spool to receive pilot fluid pressure. The hydraulic pump 42 is a pilot pump to supply pilot pressure fluid to the control valves 44 and 45.

As discussed earlier with reference to FIG. 3, the hydraulic pump 42 is a charge pump to deliver hydraulic fluid to the HSTs 31R and 31L in the traveling hydraulic system 30, and also defines and functions as a pilot pump to supply pilot pressure fluid to control the movable swash plates 32*a* of the hydraulic pumps 32R and 32L.

The working operation lever 9 is manually operated by an operator seated on the operator's seat 7. By tilting the working operation lever 9 forward or rearward, the lift arms 10 are swung (moved) up or down with respect to the machine body 2. By tilting the working operation lever 9 rightward or leftward, the attachment 16 is swung up or down with respect to the lift arms 10.

In the working machine 1, operation valves 51, 52, 53 and 54 are arranged around the base of the working operation lever 9. By tilting the working operation lever 9 in one direction, one or more of the operation valves 51, 52, 53 and 54 that correspond to that direction are actuated to deliver, as pilot pressure fluid, fluid supplied from the hydraulic pump 42.

When the working operation lever 9 is tilted forward (F) from a neutral position N, the corresponding operation valve 51 delivers pilot pressure fluid at a flow rate corresponding to the tilt angle (operation amount) of the working operation lever 9 from the neutral position N and the pressure of the pilot pressure fluid is applied to the upper pressure receiver of the lift arm control valve 44 in FIG. 4, so that the spool of the lift arm control valve 44 shifts downward in FIG. 4. Accordingly, hydraulic fluid is supplied from the lift arm control valve 44 to the rod-side fluid chambers of the lift arm cylinders 14 via the fluid supply/discharge passage 55 and hydraulic fluid is discharged from the bottom-side fluid chambers of the lift arm cylinders 14 to the lift arm control valve 44 via the fluid supply/discharge passage 56, causing the lift arm cylinders 14 to retract to lower the lift arms 10.

When the working operation lever 9 is tilted backward (B) from the neutral position N, the corresponding operation valve 52 delivers pilot pressure fluid at a flow rate corresponding to the tilt angle (operation amount) of the working operation lever 9 from the neutral position N and the pressure of the pilot pressure fluid is applied to the lower pressure receiver of the lift arm control valve 44 in FIG. 4, so that the spool of the lift arm control valve 44 shifts upward in FIG. 4. Accordingly, hydraulic fluid is supplied from the lift arm control valve 44 to the bottom-side fluid chambers of the lift arm cylinders 14 via the fluid supply/discharge passage 56 and hydraulic fluid is discharged from the rod-side fluid chambers of the lift arm cylinders 14 to the lift arm control valve 44 via the fluid supply/discharge passage 55, causing the lift arm cylinders 14 to extend to raise the lift arms 10.

When the working operation lever 9 is tilted leftward (L) from the neutral position N, the corresponding operation valve 53 delivers pilot pressure fluid at a flow rate corresponding to the tilt angle (operation amount) of the working operation lever 9 from the neutral position N and the pressure of the pilot pressure fluid is applied to the upper pressure receiver of the attachment control valve 45 in FIG. 4, so that the spool of the attachment control valve 45 shifts downward in FIG. 4. Accordingly, hydraulic fluid is supplied from the attachment control valve 45 to the bottom-side fluid chambers of the attachment cylinders 15 via the fluid supply/discharge passage 57 and hydraulic fluid is discharged from the rod-side fluid chambers of the attachment cylinders 15 to the attachment control valve 45 via the fluid supply/discharge passage 58, causing the attachment cylinders 15 to extend to swing the attachment 16 downward with respect to the right and left lift arms 10.

When the working operation lever 9 is tilted rightward (R) from the neutral position N, the corresponding operation valve 54 delivers pilot pressure fluid at a flow rate corresponding to the tilt angle (operation amount) of the working operation lever 9 from the neutral position N and the pressure of the pilot pressure fluid is applied to the lower pressure receiver of the attachment control valve 45 in FIG. 4, so that the spool of the attachment control valve 45 shifts upward in FIG. 4. Accordingly, hydraulic fluid is supplied from the attachment control valve 45 to the rod-side fluid chambers of the attachment cylinders 15 via the fluid supply/discharge passage 58 and hydraulic fluid is discharged from the bottom-side fluid chambers of the attachment cylinders 15 to the attachment control valve 45 via the fluid supply/discharge passage 57, causing the attachment cylinders 15 to retract to swing the attachment 16 upward with respect to the right and left lift arms 10.

The working operation lever 9 may be tiltable in four diagonal directions from the neutral position, and both the raising or lowering of the right and left lift arms 10 and the upward or downward swinging movement of the attachment 16 may be achieved by tilting the working operation lever 9 in one of the diagonal directions.

In such a case, for example, the following configuration may be used. Tilting the working operation lever 9 diagonally forward and leftward from the neutral position N lowers the lift arms 10 while swinging the attachment 16 downward. Tilting the working operation lever 9 diagonally forward and rightward from the neutral position N lowers the lift arms 10 while swinging the attachment 16 upward. Tilting the working operation lever 9 diagonally backward and leftward from the neutral position N raises the lift arms 10 while swinging the attachment 16 downward. Tilting the working operation lever 9 diagonally backward and rightward from the neutral position N raises the lift arms 10 while swinging the attachment 16 upward.

Figure 6:
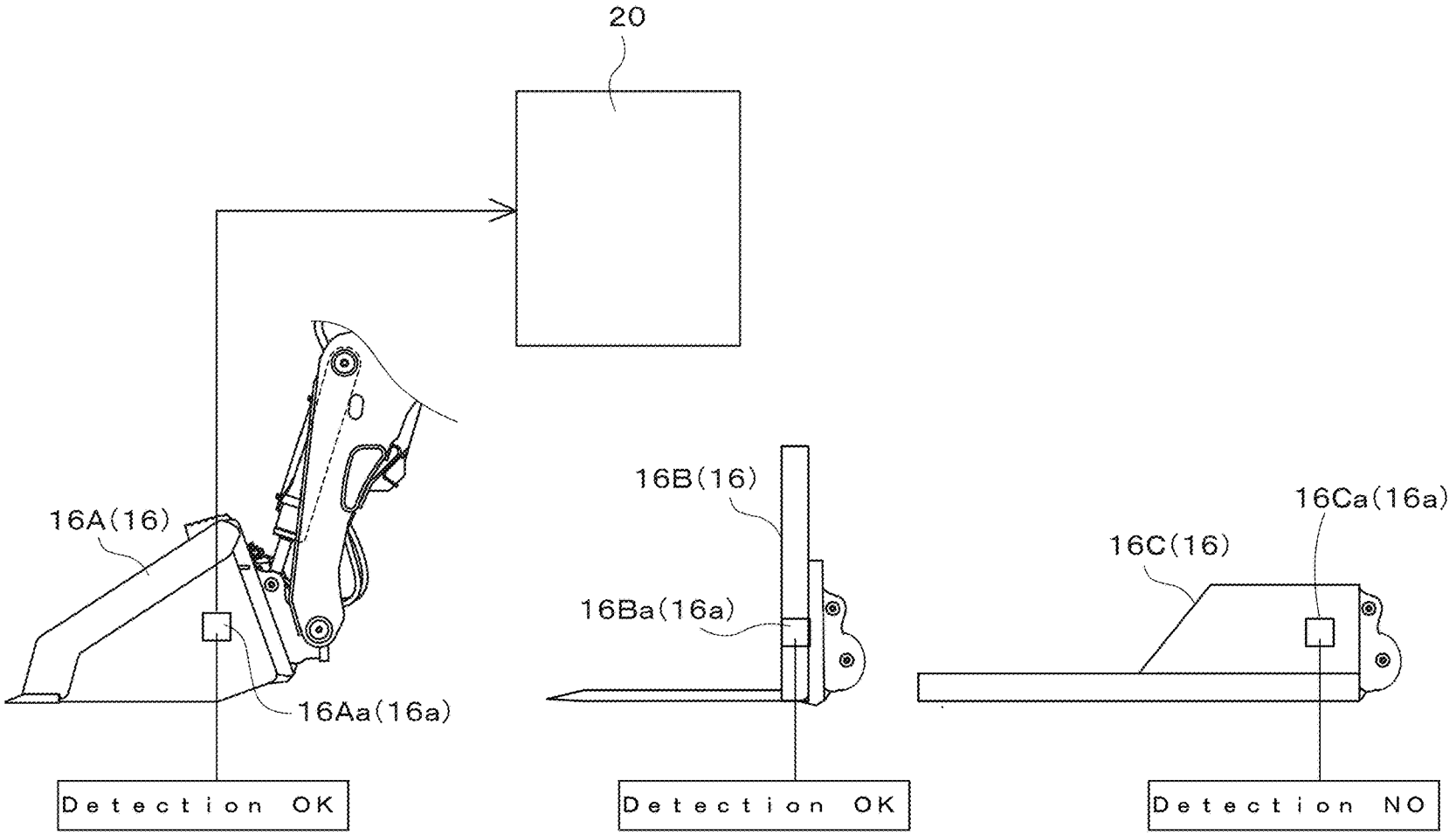
FIG. 6 illustrates a portion of a working machine according to a preferred embodiment of the present invention, showing an example of a configuration to determine whether to perform obstacle detection based on the type of attachment attached to the working device of the working machine.

Instead of the attachment 16A or 16B (the bucket or the pallet fork) not including its own drive (hydraulic actuator) as shown in FIGS. 1 and 2, an attachment 16C including a hydraulic actuator, such as a brushcutter including a hydraulic motor to drive a rotary brush as shown in FIG. 6, may be attached to the working device 4. When the attachment 16C including the hydraulic actuator is attached to the working device 4, the hydraulic actuator is fluidly connected to the AUX ports 11 as the couplers via fluid pipes and/or the like to be driven by hydraulic fluid supplied from the AUX control valve 46 via the AUX ports 11.

The working hydraulic system 40 includes solenoid valves 47 and 48 to positionally control the AUX control valve 46. The controller 20 controls the solenoid valves 47 and 48 based on operation of the AUX switch 18.

The AUX switch 18 may be a swingable seesaw switch, a slidable switch or a push switch. The AUX switch 18 is electrically connected to the input interface of the controller 20.

When the AUX switch 18 is operated, an input signal which is an electric signal corresponding to the operation direction and operation amount of the AUX switch 18 is outputted from the AUX switch 18 and is inputted to the controller 20. The solenoid valves 47 and 48 are electrically connected to the output interface of the controller 20. The controller 20 outputs current as a control signal to the solenoid valves 47 and 48 according to the input signal from the AUX switch 18.

For example, hydraulic fluid delivered from the hydraulic pump 41 via the delivery fluid passage 43 is supplied to the solenoid valves 47 and 48 as pilot pressure fluid whose pressure is to be applied to the AUX control valve 46. A source of fluid supplied to the solenoid valves 47 and 48 and to be supplied as pilot pressure fluid to the AUX control valve 46 is not illustrated in FIG. 4.

When the solenoid valve 47 receives a control signal from the controller 20 and its solenoid is energized, the solenoid valve 47 supplies pilot pressure fluid to the upper pressure receiver of the AUX control valve 46 in FIG. 4, so that the spool of the AUX control valve 46 shifts downward in FIG. 4. Accordingly, hydraulic fluid is supplied from the AUX control valve 46 to the hydraulic actuator of the attachment 16 via the suction-discharge passage 59 and the AUX ports 11 (i.e., corresponding one(s) of the AUX ports 11) and hydraulic fluid is returned from the hydraulic actuator to the AUX control valve 46 via the AUX ports 11 and the fluid supply/discharge passage 60.

When the solenoid valve 48 receives a control signal from the controller 20 and its solenoid is energized, the solenoid valve 48 supplies pilot pressure fluid to the lower pressure receiver of the AUX control valve 46 in FIG. 4, so that the spool of the AUX control valve 46 shifts upward in FIG. 4. Accordingly, hydraulic fluid is supplied from the AUX control valve 46 to the hydraulic actuator of the attachment 16 via the suction-discharge passage 60 and the AUX ports 11 and hydraulic fluid is returned from the hydraulic actuator to the AUX control valve 46 via the AUX ports 11 and the fluid supply/discharge passage 59.

The flow rate of hydraulic fluid in the delivery fluid passage 43 is adjusted by a flow adjusting valve 50 in a bleed-off fluid passage 49 branching from the delivery fluid passage 43 on the upstream side of the supply fluid passages 32*a*, 43*b* and 43*c* and extending to the reservoir tank 29. Drain fluid passages 49*a*, 49*b* and 49*c* extending from tank ports of the lift arm control valve 44, the attachment control valve 45 and the AUX control valve 46 are connected to the bleed-off fluid passage 49 on the downstream side of the flow adjusting valve 50.

The hydraulic pump 41 is a variable displacement hydraulic pump capable of changing the flow rate of fluid delivered therefrom. The working hydraulic system 40 includes a load sensing (LS) system 61 defining and functioning as a pump controller to control the flow rate of fluid delivered from the hydraulic pump 41 according to the type of work done by the working machine 1. Specifically, the LS system 61 has a predetermined load sensing (LS) differential pressure and controls the flow rate of fluid delivered from the hydraulic pump 41 so that the pressure of fluid delivered from the hydraulic pump 41 is higher than the maximum of the load pressure(s) of the working hydraulic actuator(s) by the LS differential pressure.

The working device contact prevention control system 70 (hereinafter, simply referred to as "control system 70") of FIG. 5 will be described with reference to FIGS. 1 to 4. The control system 70 includes, for example, obstacle detectors 21 and 22 and the controller 20.

The working machine 1 includes the obstacle detectors 21 and 22 to detect obstacles above the working machine 1, especially, obstacles above the AUX ports 11 on one of the lift arms 10 and higher than the cabin 3. The obstacle detectors 21 and 22 are connected to the controller 20 so that the controller 20 performs, based on the result of detection of an obstacle by the obstacle detector(s) 21 and/or 22, a process to prevent the working device 4 (especially, the lift arms 10 including the AUX ports 11) from contacting the obstacle.

As illustrated in FIGS. 1 and 2, the obstacle detector 21 is on the top of the cabin 3, and the obstacle detector 22 is on the lift arm 10 and adjacent to the AUX ports 11.

The obstacle detectors 21 and 22 may be ultrasonic sensors, optical sensors (such as laser sensors, LED sensors), infrared sensors, image capturers, and/or the like. The following description is based on the assumption that the obstacle detectors 21 and 22 include ultrasonic sensors, unless otherwise specified.

Targets to be detected by the obstacle detectors 21 and 22 will be described. The obstacle detectors 21 and 22 are provided preferably to detect obstacles above the working machine 1, for example, that would possibly come into constant with the lift arms 10, especially, the AUX ports 11 projecting from the lift arms 10, when the lift arms 10 are swung upward. The term "above the working machine 1" means "above the top of the cabin 3 defining or functioning as the protector" when the right and left lift arms 10 are in the fully lowered position.

Typical examples of such obstacles include the ceiling of a facility (e.g., a stockroom or a feed shed) in which the working machine 1 raises and lowers loads, and the upper edge of a doorway of a facility through which the working machine 1 enters and goes out of the facility carrying the load. In each of FIGS. 1 and 2, an obstacle OB1 corresponding to the ceiling and an obstacle OB2 corresponding to the upper edge of the doorway are illustrated.

In the working machine 1, it is highly likely that especially the AUX ports 11 projecting from the bent portion 10*b* of one (in the present preferred embodiment, the left lift arm 10) of the right and left lift arms 10 will contact the obstacle OB1 and/or the obstacle OB2 when the lift arms 10 are swung upward.

The AUX ports 11 are in the highest portion of one of the right and left lift arms 10 in their upward swung position. When the AUX ports 11 are positioned higher than the cabin 3, an operator seated on the operator's seat 7 in the cabin 3 can hardly see the AUX ports 11, so that the operator is hardly aware of the AUX ports 11 approaching the obstacle OB1 or OB2, and the AUX ports 11 may make accidental contact with the obstacle OB1 or OB2.

One way to prevent the couplers as the AUX ports 11 from being damaged by contacting the obstacle(s) OB1 and/or OB2 would be to provide a cover or the like on the lift arm 10 to protect the AUX ports 11. However, the contact of the cover with the obstacle(s) OB1 and/or OB2 may cause damage to the ceiling or the like as the obstacle(s) OB1 and/or OB2. Therefore, it is preferable to prevent such contact itself.

For such reasons, the working machine 1 according to the present preferred embodiment includes the obstacle detectors 21 and 22 arranged as shown in FIGS. 1 and 2 to detect the obstacle OB1 (ceiling) and the obstacle OB2 (upper edge of a doorway) above the cabin 3.

Each of the obstacle detectors 21 and 22, upon detecting the obstacle OB1 (ceiling) and/or the obstacle OB2 (upper edge of a doorway), outputs a detection signal corresponding to the position(s) of the detected obstacle(s) and/or the like and inputs the detection signal to the controller 20. On the other hand, the controller 20 is configured or programmed to cause each of the obstacle detectors 21 and 22 to start and stop performing sensing. Specifically, the controller 20 is configured or programmed to cause the obstacle detectors 21 and 22 including ultrasonic sensors to start and stop transmitting ultrasonic waves S1 and S2. In other words, the controller 20 is configured or programmed to select whether to cause the obstacle detector(s) 21 and/or 22 to perform obstacle detection.

The obstacle detector 21 is provided on the top of the cabin 3 such that the obstacles OB1 and OB2 above the cabin 3 are detectable. It is preferable that the obstacle detector 21 be as close as possible to the AUX ports 11 so that the space above the AUX ports 11 is included in the detectable area of the obstacle detector 21. In the present preferred embodiment, the AUX ports 11 are on the left lift arm 11. Therefore, the obstacle detector 21 is located on a left front end portion of the top of the cabin 3.

It is noted that, as mentioned earlier, the cabin 3 is a kind of protector to protect the operator's seat 7. Examples of such a protector include a canopy, a ROPS and so on in addition to the cabin 3. In a case where a protector other than the cabin 3 is mounted on the machine body 2 of the working machine 1 or the like, the obstacle detector 21 is provided on the top of the protector to detect the obstacles OB1 and OB2 higher than or above the protector.

The obstacle detector 21 is configured to transmit the ultrasonic waves S1, as a sensing medium, upward such that the obstacles OB1 and OB2 above the cabin 3 are detectable.

It is noted that each of the obstacle detectors 21 and 22 has a detectable area in the form of a cone centered on a line defining the direction of transmission (may be referred to as transmission direction) of the ultrasonic waves S1 or S2. The obstacle detector 21 is positioned such that its detectable area centered on the upward transmission direction of the ultrasonic waves S1 includes the space located substantially vertically above the AUX ports 11 and forward of the obstacle detector 21.

On the other hand, the obstacle detector 22 is provided on the bent portion 10*b* of the left lift arm 10 and adjacent to the AUX ports 11 such that the obstacles OB1 and OB2 above the cabin 3 are detectable.

It is noted here that the angle of the longitudinal axis of the main arm portion 10*a* (axis of the main arm portion 10*a* extending from the rear end to the bent portion 10*b*) of each lift arm 10 to the machine body 2 changes as the lift arm 10 swings up or down. Accordingly, the transmission direction of the ultrasonic waves S2, as the sensing medium of the obstacle detector 22 provided on the lift arm 10, also changes as the lift arm 10 swings up or down.

In view of the above, as shown in FIGS. 1 and 2, there is a predetermined position Pt for the working device 4 (including the lift arms 10) movable (swingable) up and down, and the obstacle detector 22 is located and oriented such that the obstacles OB1 and OB2 above the cabin 3 are detectable when the arm height is above the predetermined position Pt in a direction of the up-and-down movement (swinging movement) of the working device 4 (including the lift arms 10).

It is noted that dashed lines in FIGS. 1 and 2, which define the fully lowered position Pm (arm height) and the predetermined position Pt (arm height), respectively, each extend along the longitudinal axis of the main arm portion 10*a* of the lift arm 10 and pass through the obstacle detector 22 adjacent to the AUX ports 11.

More specifically, the obstacle detector 22 is positioned such that that the direction of transmission of the ultrasonic waves S2, as the sensing medium of the obstacle detector 22, approaches an upward direction as the arm height moves upward from the predetermined position Pt and approaches a forward (substantially horizontal) direction as the arm height moves downward the predetermined position Pt.

That is, when the arm height is above the predetermined position Pt, the obstacle detector 22 transmits the ultrasonic waves S2 upward or substantially upward, so that the obstacles OB1 and OB2 above the cabin 3 are detectable.

On the other hand, when the arm height is at or below the predetermined position Pt, the obstacle detector 22 transmits the ultrasonic waves S2 substantially in the horizontal direction, so that the obstacles OB1 and OB2 above the cabin 3 are not detectable. On the contrary, as shown in FIG. 2, for example, the obstacle detector 22 may accidentally detect a load L on a pallet fork defining or functioning as the attachment 16B located forward of the lift arms 10.

In view of the above, the controller 20 is configured or programmed to cause the obstacle detector 22 not to perform sensing (not to transmit the ultrasonic waves S2) when the arm height is at or below the predetermined position Pt, and cause the obstacle detector 22 to perform sensing (transmit the ultrasonic waves S2) when the arm height is above the predetermined position Pt.

This makes it possible for the controller 20 to perform a process to prevent the lift arms 10 (the main body 4*a* of the working device 4) from contacting the obstacle(s) OB1 and/or OB2 only when the obstacle detector 22 detects the obstacle(s) OB1 and/or OB2 above the cabin 3, and prevents the controller 20 from unnecessarily performing the process in response to the detection of an object other than the obstacles OB1 and OB2 above the cabin 3, e.g., the load L on the pallet fork (attachment 16B).

On the other hand, the obstacle detector 21 is provided on the cabin 3 such that the obstacle detector 21 transmits the ultrasonic waves S1 upward and that the obstacles OB1 and OB2 above the cabin 3 are detectable regardless of the arm height.

In view of the above, the controller 20 may be configured or programmed to cause the obstacle detector 21 to perform sensing (to transmit the ultrasonic waves S1) and cause the obstacle detector 22 not to perform sensing (not to transmit the ultrasonic waves S2) when the arm height is at or below the predetermined position Pt to allow the obstacles OB1 and OB2 above the cabin 3 to be detected by the obstacle detector 21 (detected using the ultrasonic waves S1 transmitted from the obstacle detector 21).

This achieves the following. When the lift arms 10 (the main body 4*a* of the working device 4) are in a low position in the range of up-and-down movement thereof, i.e., when the arm height is small, it is possible to eliminate or reduce the likelihood that the controller 20 will perform the process erroneously in response to the detection by the object detector 22 of an object other than the obstacles OB1 and OB2 above the cabin 3, e.g., the detection of the load L on the pallet fork defining or functioning as the attachment 16B of FIG. 2, and possible to detect the obstacles OB1 and OB2 above the cabin 3 by the obstacle detector 21. This makes it possible for an operator to know the positions (heights) and/or the like of the obstacles OB1 and OB2 above the cabin 3 even when the lift arms 10 (the main body 4*a* of the working device 4) is in a low position as mentioned above and to take care early to prevent the lift arms 10 from contacting the obstacles OB1 and OB2.

The controller 20 may be configured or programmed to cause the obstacle detector 21 not to perform sensing (not to transmit the ultrasonic waves S1) and cause the obstacle detector 22 to perform sensing (to transmit the ultrasonic waves S2) when the arm height is above the predetermined position Pt to allow the obstacles OB1 and OB2 above the cabin 3 to be detected by the obstacle detector 22 (detected using the ultrasonic waves S2 transmitted from the obstacle detector 22).

This achieves the following. When the lift arms 10 (the main body 4*a* of the working device 4) are in a high position in the range of up-and-down movement thereof, i.e., when the arm height is large, it is possible to obtain changes in position of the AUX ports 11 relative to the obstacle(s) OB1 and/or OB2 above the cabin 3 by the obstacle detector 22 moving up or down together with the lift arms 10, and also possible to accurately know how close the AUX ports 11 are to the obstacle(s) OB1 and/or OB2. This makes it possible for the controller 20 to perform an appropriate process to prevent the lift arms 10 (especially, the AUX ports 11) from contacting the obstacle(s) OB1 and/or OB2.

The above-described configuration also achieves the following. Since the obstacle detector 21 does not perform sensing (does not transmit the ultrasonic waves 51), the controller 20 does not acquire the result of the detection by the obstacle detector 21, making it possible to configure or program the controller 20 such that the controller 20 need only respond to the result of the detection by the obstruct detector 22.

Especially, since the obstacle detector 21 in the present preferred embodiment is located at the left front portion of the cabin 3 such that the detectable area of the obstacle detector 21 includes the region above the AUX ports 11 and forward of the cabin 3, the obstacle detector 21 may detect the lift arm 10 (or the AUX ports 11) as an obstacle when the arm height is higher than the predetermined position Pt.

Therefore, the controller 20, by causing the obstacle detector 21 not to perform sensing (not to transmit the ultrasonic waves 51), is capable of avoiding acquiring the result of the detection of the obstacle detector 21 representative of the lift arm 10 as an obstacle.

It is noted that the predetermined position Pt is preferably an appropriate arm height determined in consideration of the detectable areas of the obstacle detectors 21 and 22 as has been discussed.

The details are as follows. The obstacle detector 22 is provided on the lift arm 10 such that the direction of transmission of the ultrasonic waves S2 changes from a substantially forward direction to a substantially upward direction as the lift arm 10 swings upward. Therefore, the predetermined position Pt is preferably an arm height at and below which the top of the load L (for example, having an average vertical dimension) on the attachment 16B such as the pallet fork is included in the detectable area of the obstacle detector 22.

Setting the predetermined position Pt as described above makes it possible, provided that the arm height is higher than the predetermined position Pt even if only slightly, to eliminate or reduce the likelihood that the obstacle detector 22 will wrongly detect the load L on the attachment 16B such as the pallet fork as an obstacle, and possible to ensure that the obstacle detector 22 only detects objects such as a ceiling which should be detected as an obstacle.

The predetermined position Pt set in the above-mentioned way is such that the obstacle detector 22 may detect the load L on the attachment 16B such as the pallet fork when the arm height is lower than the predetermined position Pt even if only slightly. However, this means that setting the predetermined position Pt at such a low arm height makes it possible to maximize the range of arm heights within which the obstacle detector 22 is capable of detecting the obstacle(s) OB1 and/or OB2 above the cabin 3.

Alternatively, the working machine 1 may include only either one of the obstacle detectors 21 and 22. For example, the working machine 1 may include only the obstacle detector 21 on the cabin 3 and may be configured such that the controller 20 performs a process to prevent the lift arms 10 (AUX ports 11) from contacting the obstacle(s) OB1 and/or OB2 based on positional information and/or the like regarding the obstacle(s) OB1 and/or OB2 above the cabin 3 detected regardless of changes in the arm height.

Alternatively, the working machine 1 may include only the obstacle detector 22 on one of the lift arms 10 and may be configured such that the obstacle detector 22 performs sensing (transmits the ultrasonic waves S2) to detect the obstacle(s) OB1 and/or OB2 above the cabin 3 only when the lift arms 10 are higher than the predetermined position Pt.

To provide the configuration in which the obstacle detectors 21 and 22 (or only the obstacle detector 22) start or stop performing sensing depending on whether the lift arms 10 are above or below the predetermined position Pt as described above, it is necessary to detect the position of the lift arms 10 in the up-and-down direction, i.e., the arm height.

To this end, an arm height detector 23 to detect arm height is connected to the input interface of the controller 20.

The arm height may be detected by detecting, for example, the tilt angle of the lift arms 10. For example, the arm height detector 23 may be a rotation angle sensor to detect the angle between one of the lift arms 10 and a corresponding one of the lift links 12.

The arm height detector 23 may be, for example, an angle sensor to detect the tilt angle of the lift arms 10 or a displacement sensor to detect height provided on one of the lift arms 10 and adjacent to the AUX ports 11. The obstacle detector 22 and the arm height detector 23 may be assembled into an assembly mounted on the lift arm 10 and adjacent to the AUX ports 11. Additionally or alternatively, a device functioning both as the obstacle detector 22 and the arm height detector 23 may be provided on one of the lift arms 10 and adjacent to the AUX ports 11.

The controller 20 includes a calculator 20*a* and a memory 20*b*. The memory 20*b* stores the predetermined position Pt. The calculator 20*a* acquires an arm height from a detection signal inputted from the arm height detector 23, and compares the arm height with the predetermined position Pt stored in the memory 20*b*. The calculator 20*a* determines whether to cause the obstacle detectors 21 and 22 (or only the obstacle detector 22) to perform sensing or not to perform sensing based on whether the arm height is above or below the predetermined position Pt.

The controller 20 is configured or programmed to determine, based on the type of the attachment 16 attached to the working device 4, whether to cause the obstacle detector(s) 21 and/or 22 to perform the obstacle detection.

An attachment 16 of a type corresponding to work to be done by the working machine 1 is attached to the working device 4 (lift arms 10). That is, "determining whether to perform the obstacle detection based on the type of the attachment 16 attached to the working device 4" means determining whether to perform the obstacle detection based on the type of the work to be done by the working machine 1.

When the controller 20 determines not to perform the obstacle detection, the controller 20 causes the obstacle detectors 21 and 22 not to perform sensing (not to transmit the ultrasonic waves S1 and S2) while the working machine 1 in operation regardless of the arm height (regardless of whether the arm height is above or below the predetermined position Pt).

The above-mentioned configuration achieves the following, for example. When an attachment 16C such as a brushcutter, designed for grass mowing in the bush as shown in FIG. 6, is attached to the working device 4, the controller 20 determines not to cause the obstacle detector(s) 21 and/or 22 to perform the obstacle detection. This prevents the following from occurring: during the grass mowing in the bush, shrubs or tall grasses or the like are detected by the obstacle detectors 21 and 22, a process to prevent the contact of the working device 4 (such as issuing a warning, reducing the speed of driving of the attachment 16 or the lift arms 10, or so on) is frequently performed, and the work is hindered.

Examples of attachments 16 categorized as an attachment for which the obstacle detector(s) 21 and/or 22 are/is not caused to perform the obstacle detection include the above-mentioned brushcutter to mow grass, a tree puller to pull up shrubs or trees, a snowblower and so on.

The reason why the tree puller is categorized as such an attachment is to prevent trees from being detected as obstacles. The reason why the snowblower is categorized as such an attachment is as follows. The snowblower is not supposed to be used in an indoor space or under the ceiling or to be used with the lift arms 10 in a raised position. Therefore, it is not necessary to take into consideration the contact of the lift arms 10 (AUX ports 11) with the obstacle OB1 or OB2 above the cabin 3. It is necessary, however, to prevent snow blown up by the snowblower from being detected as obstacles. Other types of attachments 16 supposed to be used under the same or similar situation may be categorized as an attachment for which the obstacle detection is not performed.

On the other hand, examples of attachments 16 categorized as an attachment for which the obstacle detector(s) 21 and/or 22 are or is caused to perform the obstacle detection include the bucket defining or functioning as the attachment 16A as shown in FIG. 1, the pallet fork defining or functioning as the attachment 16B as shown in FIG. 2, a dozer blade and so on. Examples of work done by the working machine 1 with the attachment 16A such as the bucket or the dozer blade attached to the working device 4 include carrying an object (such as feed or manure) out of a storehouse and lifting up and carrying an object from an outdoor space to an indoor space.

During such transportation between the outdoor space and the indoor space, the working machine 1 with the lift arms 10 in a raised position frequently passes through the doorway of the storehouse. Therefore, the AUX ports 11 projecting from one of the lift arms 10 should be prevented from contacting the upper edge of the doorway (the obstacle OB2 in FIG. 1). In view of the above, by determining to cause the obstacle detector(s) 21 and/or 22 to perform the obstacle detection when a bucket or a dozer blade is attached to the working device 4, it is possible to cause the obstacle detector 22 adjacent to the AUX ports 11 to detect the upper edge of the doorway as an obstacle when the lift arms 10 are positioned higher than the predetermined position Pt, making it possible to prevent the AUX ports 11 from contacting the upper edge of the doorway.

Figure 5:
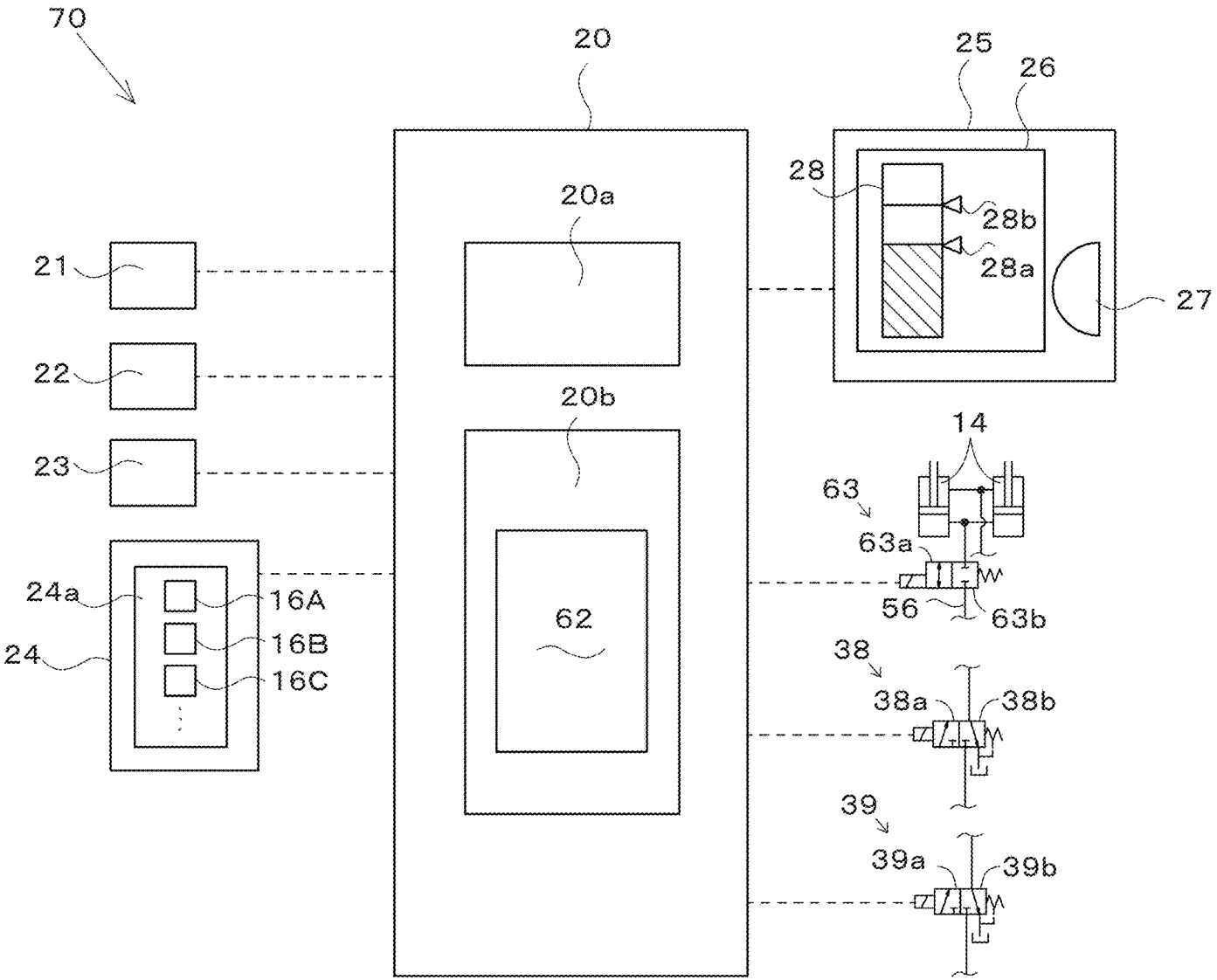
FIG. 5 is a block diagram of a control system to prevent a working device of a working machine according to a preferred embodiment of the present invention from contacting an obstacle.

There are at least two preferred embodiments as shown in FIGS. 5 and 6 to achieve the above-mentioned configuration where the controller 20 determines whether or not to cause the obstacle detector(s) 21 and/or 22 to perform obstacle detection based on the type of the attachment 16 attached to the working device 4.

In the preferred embodiment of FIG. 5, the memory 20*b* of the controller 20 stores information 62. The information 62 includes a list of different types of attachments 16 that may be attached to the working device 4 (for example, including the attachments 16A, 16B and 16C as shown in FIG. 6) and information regarding each type of attachment 16. The information regarding each type of attachment 16 includes information regarding whether to cause the obstacle detector(s) 21 and/or 22 to perform the obstacle detection.

An attachment selector 24 as an input device is connected to the input interface of the controller 20. The attachment selector 24 includes a touchscreen 24*a* and/or another input device such as a switch, and is positioned adjacent to the operator's seat 7 in the cabin 3 such that the attachment selector 24 can be operated by the operator seated on the operator's seat 7.

The attachment selector 24 is operable by an operator seated on the operator's seat 7 to select one type of attachment 16 from the different types of attachments 16 stored in the memory 20*b*.

For example, as shown in FIG. 5, in a case where the attachment selector 24 includes the touchscreen 24*a*, the touchscreen 24*a* functioning as a display may display a list of different types of attachments 16A, 16B, 16C, . . . and so on stored in the memory 20*b*, and an operator may press a portion representing one attachment 16 of the list displayed on the touchscreen 24*a* with their finger to select the one attachment 16.

Another example would be a configuration in which switches corresponding to the respective types of attachments 16 stored in the memory 20*b* are provided and, upon turning ON of one of the switches, a corresponding one of the attachments 16 is selected.

The controller 20 determines whether to cause the obstacle detector(s) 21 and/or 22 to perform the obstacle detection, based on the type of the attachment 16 selected using the attachment selector 24.

With the preferred embodiment of FIG. 5, the operator need only select a corresponding attachment 16 from the list displayed by the attachment selector 24. The operator themselves does not have to determine whether to perform the obstacle detection. It is also not necessary to store information regarding the determination of whether to perform the obstacle detection in a memory included in each attachment 16.

In the preferred embodiment of FIG. 6, different types of attachments 16 (attachments 16A, 16B, 16C, . . . and the like) include respective memories 16*a* (memories 16Aa, 16BA, 16Ca, . . . and the like) such as IC chips. Each of the memories 16*a* (memories 16Aa, 16BA, 16Ca, . . . and the like) stores information regarding a corresponding attachment 16 (attachment 16A, 16B, 16C, . . . or the like) including information regarding whether to cause the obstacle detector(s) 21 and/or 22 to perform the obstacle detection.

Each of the attachments 16 (attachments 16A, 16B, 16C, . . . and so on) has a communication function to transmit a signal corresponding to the information stored in its corresponding memory 16*a* (memory 16Aa, 16Ba, 16Ca, . . . or the like) to the controller 20 of the machine body 2. An example of the communication function would be radiocommunication via Bluetooth (registered trademark) or infrared communication. Another example would be wired communication via a harness or the like.

The controller 20 receives a signal corresponding to information stored in the memory 16*a* (in the present preferred embodiment, the memory 16Aa) from the attachment 16 (in the present preferred embodiment, the attachment 16A) attached to the working device 4, reads from the signal the information regarding whether to cause the obstacle detector(s) 21 and/or 22 to perform the obstacle detection, and determines whether to perform the obstacle detection. When the controller 20 determines not to perform the obstacle detection, the controller 20 causes the obstacle detectors 21 and 22 not to perform sensing regardless of changes in the arm height.

In the present preferred embodiment, when the operator selects an attachment 16 suitable for intended work and attaches the attachment 16 to the working device 4, whether to perform the obstacle detection is automatically determined appropriately for the selected attachment 16. The operator does not have to select whether to perform the obstacle detection in consideration of the substance of the work done using the attachment 16.

Note that the following simple configuration may be used: an ON/OFF switch operable to select whether to cause the obstacle detector(s) 21 and/or 22 to perform the obstacle detection is provided, and whether to perform the obstacle detection is determined by the operator's optional manual operation of the switch, regardless of which type of attachment 16 is attached to the working device 4. The switch may be provided in addition to the attachment selector 24 or instead of the attachment selector 24.

A description will now be given of process(es) performed by the controller 20 to prevent the working device 4 (lift arms 10, AUX ports 11) from contacting the obstacle(s) OB1 and/or OB2 above the cabin 3 when the obstacle(s) OB1 and/or OB2 are or is detected by the obstacle detectors 21 and 22.

As illustrated in FIG. 5, a notifier 25 including a display 26 and an audio device 27 such as an alarm is electrically connected to the controller 20. When the obstacle detector(s) 21 and/or 22 detect(s) the obstacle(s) OB1 and/or OB2, the controller 20 causes the notifier 25 to notify an operator seated on the operator's seat 7 of at least the presence of the obstacle(s) OB1 and/or OB2.

The display 26 is located adjacent to the operator's seat 7 in the cabin 3 such that the operator seated on the operator's seat, when facing forward, can see the display 26. When the obstacle detector(s) 21 and/or 22 detect(s) the obstacle(s) OB1 and/or OB2 above the cabin 3, the display 26 displays an indication to notify the operator of at least the presence of the obstacle(s) OB1 and/or OB2. The indication may be, for example, in the form of text such as "Beware obstacles" or a lamp lighting up or flashing.

The display 26 may also serve as the touchscreen 24*a* of the foregoing attachment selector 24. Specifically, the display 26 may be configured to display the lift of different types of attachments 16 stored in the memory 20*b* and serve as a touch panel functioning as an input device via which a signal representing the attachment 16 selected by the operator is inputted into the controller 20.

When the obstacle detector(s) 21 and/or 22 detect(s) the obstacle(s) OB1 and/or OB2 above the cabin 3, the controller 20 causes the audio device 27 to produce a warning sound. The notifier 25 may additionally or alternatively include a vibrator to generate vibration to provide a perceptible physical notification to the operator. The notifier 25 may include the display 26, the audio device 27 or the vibrator.

The display 26 also displays an arm height indicator 28, as shown in FIG. 5. The arm height indicator 28 is a vertically elongated virtual gauge. The bottom end of the virtual gauge as the arm height indicator 28 represents the fully lowered position Pm of the lift arms 10. The top end of the virtual gauge as the arm height indicator 28 represents the fully raised position of the lift arms 10.

The controller 20 receives a detection signal representing the arm height detected by the arm height detector 23. The controller 20 causes the display 26 to display an arm height index 28*a* at the position on the arm height indicator 28 that corresponds to the arm height represented by the detection signal. This allows the operator to know, by looking at the arm height index 28*a* on the arm height indicator 28, the current height of the lift arms 10 between the fully lowered position Pm and the fully raised position in the range of up-and-down movement of the lift arms 10.

As illustrated in FIG. 5, the area between the bottom end of the arm height indicator 28 and the arm height index 28*a* may be colored differently from the area between the top end of the arm height indicator 28 and the arm height index 28*a* so that the operator can easily recognize the arm height from the fully lowered position Pm.

When the obstacle detector(s) 21 and/or 22 detect(s) the obstacle(s) OB1 and/or OB2, the controller 20 reads the height(s) of the obstacle(s) OB1 and/or OB2 from the detection signal(s) from the obstacle detector(s) 21 and/or 22. If the height(s) of the obstacle(s) OB1 and/or OB2 are or is between the fully lowered position Pm and the fully raised position of the lift arms 10, the controller 20 causes the display 26 to display the obstacle height index(es) 28*b* at the position(s) on the arm height indicator 28 that correspond(s) to the height(s).

It follows that the arm height index 28*a* and the obstacle height index 28*b* are indicated on the arm height indicator 28. In other words, the arm height indicator 28 indicates the position of the working device 4 relative to the position(s) of the obstacle(s) OB1 and/or OB2. This allows the operator seated on the operator's seat 7 to check, by looking at the arm height indicator 28, how close the lift arms 10 (AUX ports 11) are to the obstacle(s) OB1 and/or OB2 based on, for example, the gap(s) between the arm height index 28*a* and the obstacle height index(es) 28*b*.

In a case where the attachment 18B such as a pallet fork is attached to the working device 4 and the working device 4 (lift arms 10) is repeatedly raised and lowered in an indoor space as illustrated in FIG. 2, it is particularly preferable to prevent the working device 4 from contacting the obstacle OB1 such as the ceiling of the storehouse as illustrated in FIG. 2. In such a case, an effective process to prevent the working device 4 from contacting the obstacle OB1 is reducing the speed of the upward movement of the working device 4 (lift arms 10) to delay the approach of the working device 4 to the obstacle OB1 or stopping the upward movement of the lift arms 10 to prevent the working device 4 from further approaching the obstacle OB1.

In view of the above, in the working hydraulic system 40, the fluid supply/discharge passage 56 between the bottom-side fluid chambers of the lift arm cylinders 14 and the lift arm control valve 44 (see FIG. 4) is provided, at an intermediate portion thereof, with, a solenoid valve 63 electrically connected to the output interface of the controller 20 (see FIG. 5).

The spool of the solenoid valve 63 is biased to a blocking position 63*b* to block the fluid supply/discharge passage 56. When a solenoid of the solenoid valve 63 is energized by a control signal (current) output from the controller 20, the spool of the solenoid valve 63 moves against the biasing force to an opening position 63*a* to open the fluid supply/discharge passage 56. FIG. 5 illustrates the solenoid valve 63 in the blocking position 63*b*.

In the present preferred embodiment, the solenoid valve 63 is a solenoid proportional valve configured such that, by adjusting the value of the control signal (the amount of current) applied to the solenoid, the degree of movement of the spool between the opening position 63*a* and the blocking position 63*b* is adjusted and therefore the opening degree of the solenoid valve 63 is adjusted. Since the solenoid valve 63 is a solenoid proportional valve, it is possible to change the flow rate of hydraulic fluid flowing through the fluid supply/discharge passage 56 between the bottom-side fluid chambers of the lift arm cylinders 14 and the lift arm control valve 44 to change the speed of the up-and-down movement of the working device 4 (lift arms 10). That is, it is possible to reduce the speed of movement of the working device 4 (lift arms 10) to prevent the working device 4 from contacting an obstacle.

The solenoid valve 63 configured as shown in FIG. 5 is usually (when no obstacles are detected) in the opening position 63*a* (fully open position) in response to the control signal (current) from the controller 20. When the solenoid valve 63 is in the opening position 63*a* (fully open position), the fluid delivered by the lift arm control valve 44 into the fluid supply/discharge passage 56 is entirely supplied to the bottom-side chambers of the lift arm cylinders 14.

When the obstacle detector(s) 21 and/or 22 detect(s) the obstacle OB1 while the lift arms 10 (working device 4) are moved upward, i.e., while the bottom-side fluid chambers of the lift arm cylinders 14 are supplied with hydraulic fluid from the lift arm control valve 44 through the fluid supply/discharge passage 56, the controller 20 reduces the value of the control signal (the amount of current) for energization of the solenoid of the solenoid valve 63, thus moving the spool of the solenoid valve 63 from the opening position 63*a* toward the blocking position 63*b*. This reduces the flow rate of hydraulic fluid from the lift arm control valve 44 to the bottom-side fluid chambers of the lift arm cylinders 14 through the fluid supply/discharge passage 56 to reduce the speed of upward movement of the lift arms 10.

As the lift arms 10 (AUX ports 11) approach the obstacle OB1, the controller 20 increases the degree of the movement of the spool of the solenoid valve 63 from the opening position 63*a* toward the blocking position 63*b* to reduce the opening degree of the solenoid valve 63, thus reducing the flow rate of fluid flowing through the fluid supply/discharge passage 56 to reduce the speed of extension of the lift arm cylinders 14, i.e., reduce the speed of movement of the lift arms 10.

Eventually, when the working device 4 (the lift arms 10, AUX ports 11) reaches a position in close proximity to the obstacle OB1 (for example, when the distance between the working device 4 and the obstacle OB1 decreases and reaches a predetermined value), the amount of current applied to the solenoid of the solenoid valve 63 reaches a minimum value (for example, zero), so that the spool of the solenoid valve 63 reaches the blocking position 63*b* and that the flow rate of hydraulic fluid supplied from the lift arm control valve 44 to the bottom-side fluid chambers of the lift arm cylinders 14 through the fluid supply/discharge passage 56 is zero. This stops the extension of the lift arm cylinders 14 to stop the upward movement of the lift arms 10 to prevent the lift arms 10 from contacting the obstacle OB1.

The solenoid valve 63 may be, instead of a proportional valve, a simple two-position on-off valve switchable between the opening position 63*a* and the blocking position 63*b*. In such a case, the solenoid valve 63 usually in the opening position 63*a* may be switched to the blocking position 63*b* when the distance from the lift arms 10 (AUX ports 11) to the obstacle OB1 decreases and reaches a predetermined value.

Alternatively, the solenoid valve 63 may be configured such that the solenoid valve 63 is biased to the opening position 63*a* and is switched to the blocking position 63*b* upon energization of its solenoid. In such a case, usually (when no obstacle is detected) the controller 20 does not output the control signal (current) to the solenoid valve 63, so that the solenoid of the solenoid valve 63 is not energized. When the solenoid valve 63 is a solenoid proportional valve, as the lift arms 10 (AUX ports 11) approach the detected obstacle OB1, the degree of movement of the spool of the solenoid valve 63 from the opening position 63*a* toward the blocking position 63*b* is increased by increasing the value of the control signal (the amount of current) applied to the solenoid of the solenoid valve 63 from the controller 20.

It is noted that that another way to reduce the speed of extension of the lift arm cylinders 14 to reduce the speed of upward movement of the lift arms 10 as the lift arms 10 approach the obstacle OB1, instead of providing an additional component such as the solenoid valve 63, would be to reduce the degree of movement of the spool of the lift arm control valve 44 from the neutral position to reduce the flow rate of fluid supplied into the fluid supply/discharge passage 56 from the lift arm control valve 44.

This can be achieved by a structure in which the controller 20 is configured or programmed to control the degree of movement of the spool of the lift arm control valve 44 regardless of the position of the working operation lever 9. An example of such a structure would be a structure including solenoid valve(s) to be controlled by the controller 20 to supply pilot pressure fluid to the lift arm control valve 44, such as solenoid valve(s) equivalent to the operation valves 51 to 54. Such an example will be detailed later with reference to FIG. 7. Another example would be to use a solenoid valve as the lift arm control valve 44 and cause the controller 20 to directly control the energization of the solenoid of the lift arm control valve 44.

In a case where the working machine 1 with the attachment 16A such as a bucket attached to the working device 4 enters and goes out of a storehouse or the like carrying a load as illustrated in FIG. 1, it is particularly preferable to prevent the working device 4 from contacting the obstacle OB2 such as the upper edge of the doorway of the storehouse or the like. In such a case, an effective process to prevent the working device 4 from contacting the obstacle OB2 is reducing the travel speed of the working machine 1 to delay the approach of the working machine 1 to the obstacle OB2. This is because reducing the travel speed of the working machine 1 provides enough time for the operator to do something, such as lowering the working device 4, to prevent the working device 4 from contacting the obstacle OB2. Furthermore, when the travel speed decreases, the operator easily notices that something abnormal is occurring and easily recognizes that the speed reduction is because of the obstacle OB2.

In view of the above, as illustrated in FIG. 5, the speed-shift solenoid switching valve 38 is connected to the output interface of the controller 20 used in the control system 70. When the obstacle detector(s) 21 and/or 22 detect(s) the obstacle OB2 and the controller 20 determine, based on information regarding the position and/or the like of the obstacle OB2 represented by the detection signal from the obstacle detector(s) 21 and/or 22, to reduce the travel speed of the working machine 1, the controller 20 outputs a control signal to the speed-shift solenoid switching valve 38 to shift the speed-shift solenoid switching valve 38 to the open position 38*a* even if the speed-shift switch 17 is in the high speed position. It follows that the movable swash plates 33*a* of the hydraulic motors 33R and 33L are shifted to their low-speed tilt position (large angled position) to shift the traveling speed stage of the right and left traveling devices 512 and 5L to the low speed stage.

This reduces the travel speed of the working machine 1 to delay the approach of the lift arms 10 to the obstacle OB2, thus providing enough time for the operator to notice the approach of the lift arms 10 to the obstacle OB2 and to do something such as operating the working operation lever 9 to lower the lift arms 10.

Examples of a process to reduce travel speed, in addition to the above-mentioned process performed by the controller 20 to control the speed-shift solenoid switching valve 38 to shift the movable swash plates 33*a* of the hydraulic motors 33R and 33L to the low-speed tilt position, also include a process performed by the controller 20 to control the brake solenoid switching valve 39 to brake the hydraulic motors 33R and 33L, a process performed by the controller 20 to control a governor of the prime mover 6 such as a diesel engine to reduce the fuel injection amount to reduce the rotary speed of the prime mover 6, and a process performed by the controller 20 to reduce tilt angles of the movable swash plates 32*a* of the hydraulic pumps 32R and 32L.

An example way to allow the controller 20 to change tilt angles of the movable swash plates 32*a* independently of the operation of the traveling operation lever 8 is providing solenoid valve(s) to be controlled by the controller 20 to supply pilot pressure fluid to the pressure receivers 32*b* and 32*c* of each of the hydraulic pumps 32R and 32L, such as solenoid valve(s) equivalent to the pump control valves 35. Such an example will be detailed later with reference to FIG. 8.

Another example way is to connect electric actuators, e.g., electric motors or electric cylinders, to the movable swash plates 33*a* of each of the hydraulic motors 33R and 33L instead of or in addition to the swash plate control actuators 33*b* including the hydraulic cylinders, and cause the controller 20 to electrically or electronically control the electric actuators to control the movable swash plates 33*a*. A further example way is to connect electric actuators, e.g., electric motors or electric cylinders, to the movable swash plates 32*a* of each of the hydraulic pumps 32R and 32L instead of or in addition to the pressure receivers 32*b* and 32*c* for receiving fluidal pilot pressures, and cause the controller 20 to electrically or electronically control the electric actuators to control the movable swash plates 32*a*.

Instead of or in addition to reducing the travel speed of the working machine 1 as the working machine 1 approaches the obstacle OB2, the travel of the working machine 1 may be stopped. That is, the traveling device 5 may be slowed or stopped to slow or stop the travel of the working machine 1. To stop the travel of the working machine 1, the brake solenoid switching valve 39, which is connected to the controller 20 as shown in FIG. 5, may be shifted to the open position 39*a* (see FIG. 3) to cause the brake actuators 33*c* to brake the hydraulic motors 33R and 33L. Alternatively, the movable swash plates 32*a* of the hydraulic pumps 32R and 32L may be shifted to their neutral position.

A description will be given of a preferred embodiment illustrated in FIG. 7 in which a control system 70A as a variation of the control system 70 is applied to a working hydraulic system 40A as a variation of the working hydraulic system 40. The working machine 1 including the working hydraulic system 40A includes, instead of the working operation lever 9, a working operation lever 91 that is an electric joystick, as a lever operable for work. A lever position sensor 92 is provided on the base of the working operation lever 91 and connected to the input interface of the controller 20. The lever position sensor 92 issues an electric signal representing the tilt direction and angle of the working operation lever 91, and the electric signal is input to the controller 20.

The working hydraulic system 40A includes solenoid valves 66 and 67 to supply pilot pressure fluid to the lift arm control valve 44 and solenoid valves 68 and 69 to supply pilot pressure fluid to the attachment control valve 45, instead of the operation valves 51 to 54. The controller 20 positionally controls one or more of the solenoid valves 66, 67, 68 and 69 based on the electric signal from the lever position sensor 92, thus controlling the pilot pressure fluid supply to the lift arm control valve 44 and the attachment control valve 45 to control the flow (direction and flow rate) of hydraulic fluid through the fluid supply/discharge passages 55 and 56 between the lift arm control valve 44 and the lift arm cylinders 14 and the flow (direction and flow rate) of hydraulic fluid through the fluid supply/discharge passage 57 and 58 between the attachment control valve 45 and the attachment cylinders 15.

Figure 7:
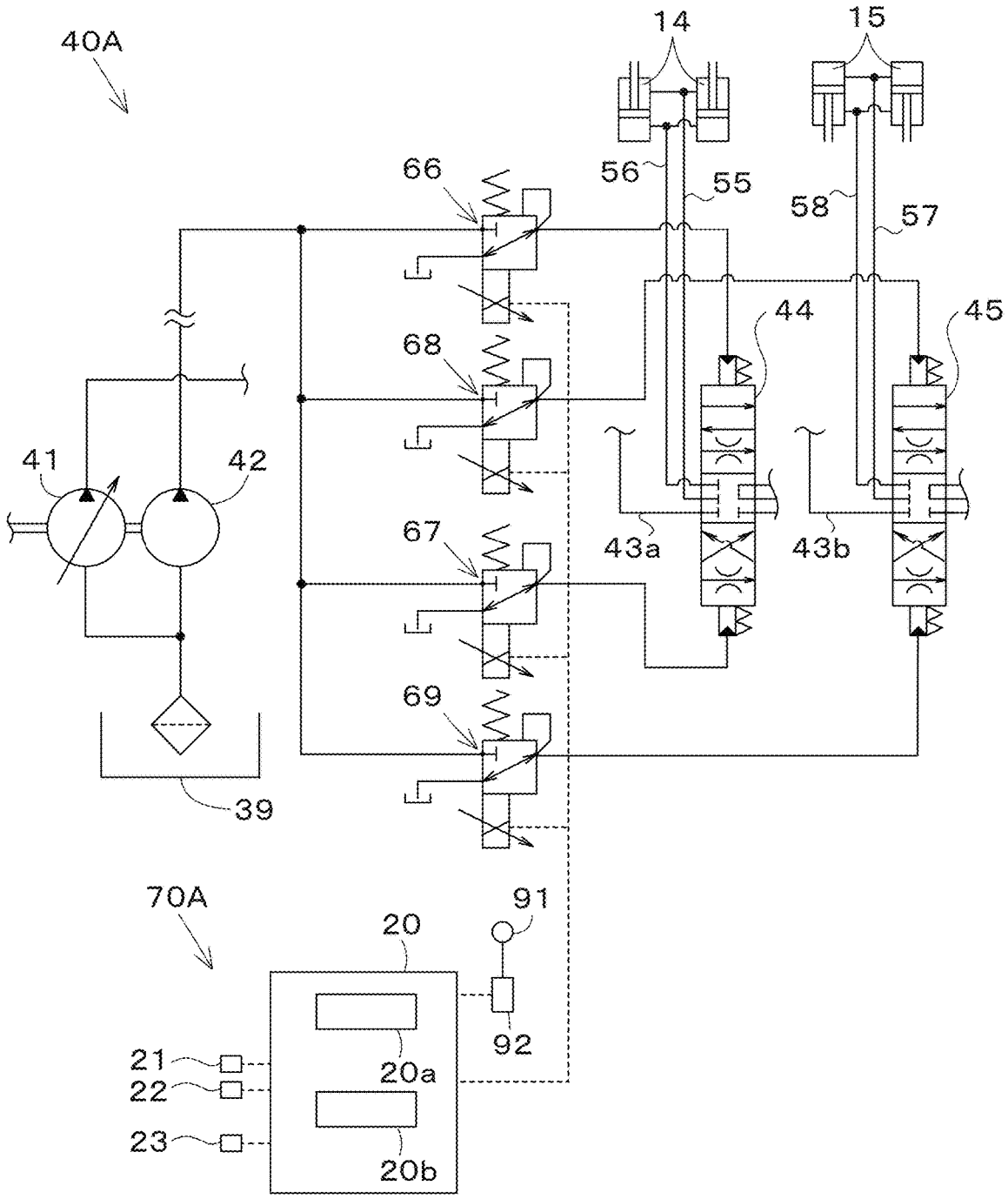
FIG. 7 is a circuit diagram of a variation of a working hydraulic system in which a variation of a control system to prevent a working device of a working machine according to a preferred embodiment of the present invention from contacting an obstacle is applied.

In the preferred embodiment of FIG. 7, the controller 20 is also connected to the obstacle detectors 21 and 22 and the arm height detector 23. Such devices 20, 21, 22 and 23 and the solenoid valves 66, 67, 68 and 69 of the working hydraulic system 40A and the like are included in the control system 70A to prevent the working device 4 from contacting obstacles. It is noted that the control system 70A includes one or more of the elements of the control system 70 that are applicable to the control system 70A (such one or more of the elements are not illustrated in FIG. 7).

In the control system 70A, the controller 20 reads the detected position of an obstacle from the obstacle detector(s) 20 and/or 21 and the detected arm height from the arm height detector 23 to determine how close the lift arms (AUX ports 11) are to the obstacle. Based on this, the controller 20 positionally controls, for example, the solenoid valve 66 or 67 to positionally control the lift arm control valve 44, thus reducing or zeroing the flow rate of hydraulic fluid through the fluid supply/discharge passage 55 and 56 between the lift arm cylinders 14 and the lift arm control valve 44 to slow or stop the movement of the lift arm cylinders 14 and the lift arms 10.

In this way, in the control system 70A which works together with the working hydraulic system 40A, the controller 20 controls the solenoid valves 66, 67, 68 and 69 based on the obstacle detection by the obstacle detector(s) 21 and/or 22 and the arm height detection by the arm height detector 23 (instead of based on the operation of the working operation lever 91) to slow or stop the movement of the working device 4 (lift arms 10 and AUX ports 11) toward obstacle(s) (OB1, OB2 and/or the like), as a process to prevent the working device 4 from contacting the obstacle(s).

The controller 20 is capable of determining how actually close the working device 4 (lift arms 10 and AUX ports 11) is to obstacle(s) by reading the detected (actual) arm height from the arm height detector 23, and is also capable of predicting the arm height by reading the detected position of the working operation lever 91 from the lever position sensor 92. Therefore, the controller 20 is capable of predicting how close the working device 4 will come to the obstacle(s) prior to determining actually how close the working device 4 is to the obstacle(s). Thus, the controller 20 is capable of starting, at an early stage of the operation to raise the lift arms 10, to control the solenoid valves 66, 67, 68 and 69 based on the prediction of how close the working device 4 will come to the obstacle(s).

A description will be given of a preferred embodiment illustrated in FIG. 8 in which a control system 70B as a variation of the control system 70 is applied to a traveling hydraulic system 30A as a variation of the traveling hydraulic system 30. The working machine 1 including the traveling hydraulic system 30A includes, instead of the traveling operation lever 8, a traveling operation lever 81 that is an electric joystick, as a lever operable for travel. A lever position sensor 82 is provided on the base of the traveling operation lever 81 and connected to the input interface of the controller 20. The lever position sensor 82 issues an electric signal representing the tilt direction and angle of the traveling operation lever 81, and the electric signal is input to the controller 20.

The traveling hydraulic system 30A includes, instead of the pump control valves 35, solenoid valves 65 to supply pilot pressure fluid to the pressure receives 32*b* and 32*c* of the hydraulic pumps 32R and 32L to control the respective movable swash plates 32*a* of the hydraulic pumps 32R and 32L. The controller 20, based on the electric signal from the lever position sensor 82, positionally controls one or more of the solenoid valves 65, thus controlling the pilot pressure fluid supply to the pressure receivers 32*b* and 32*c* of the hydraulic pump 32R and the pressure receivers 32*b* and 32*c* of the hydraulic pump 32L to control the flow rate and direction of fluid delivered by the hydraulic pumps 32R and 32L.

Figure 8:
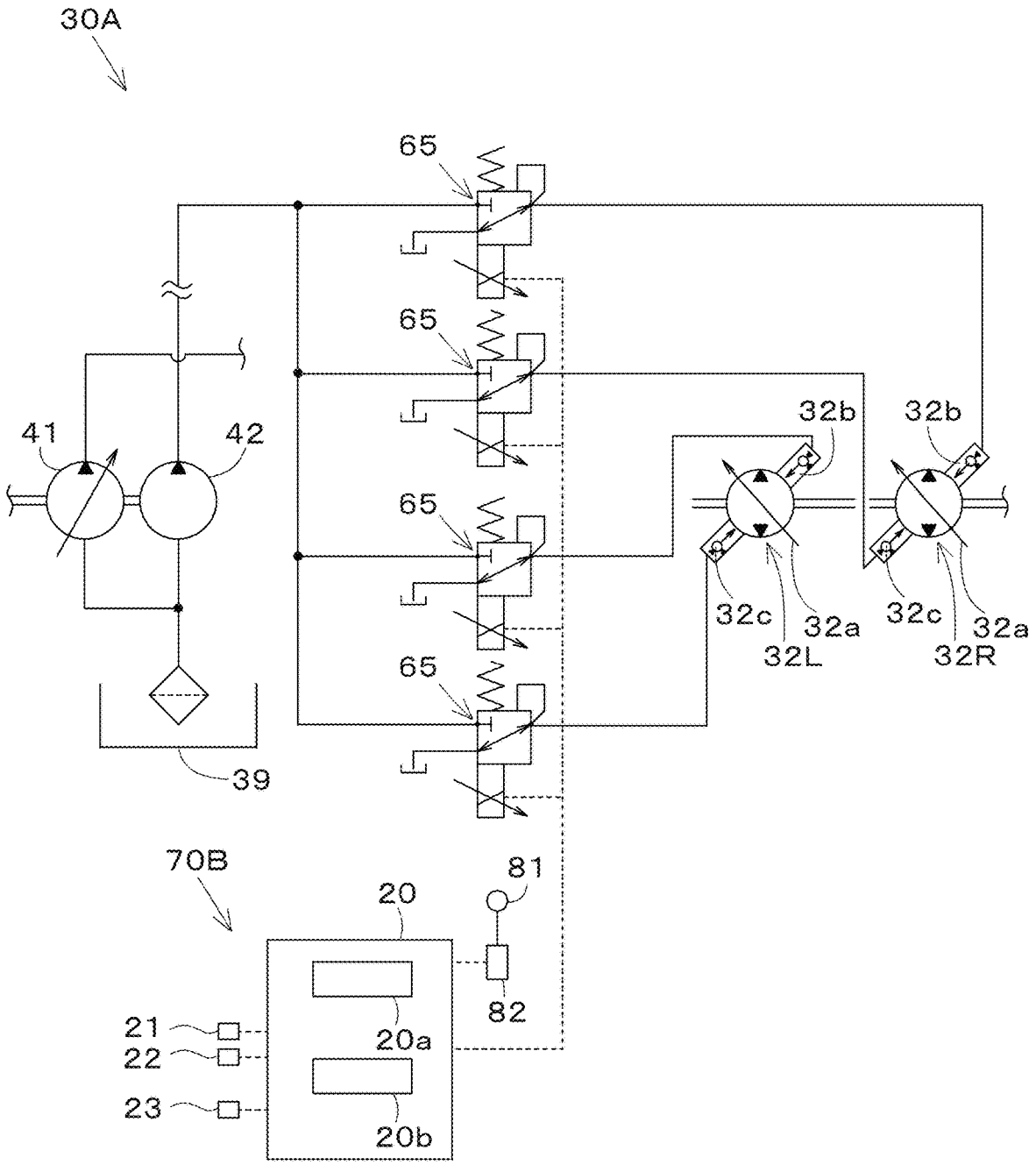
FIG. 8 is a circuit diagram of a variation of a traveling hydraulic system in which a variation of a control system to prevent a working device a working machine according to a preferred embodiment of the present invention from contacting an obstacle is applied.

In the preferred embodiment of FIG. 8, the controller 20 is also connected to the obstacle detectors 21 and 22 and the arm height detector 23. Such devices 20, 21, 22 and 23 and the solenoid valves 65 of the traveling hydraulic system 30A and the like are included in the control system 70B to prevent the working device 4 from contacting obstacles. It is noted that the control system 70B includes one or more of the elements of the control system 70 that are applicable to the control system 70B (such one or more of the elements are not illustrated in FIG. 8).

In the control system 70B, the controller 20 reads the detected position of an obstacle from the obstacle detector(s) 20 and/or 21 and the detected arm height from the arm height detector 23 to determine how close the lift arms (AUX ports 11) are to the obstacle. Based on this, the controller 20 positionally controls, for example, at least one of the solenoid valves 65 to reduce or zero the flow rate of fluid delivered by the hydraulic pumps 32R and 32L, thus slowing or stopping the traveling drive of the traveling device 5 (right traveling device 5R and left traveling device 5L).

In this way, in the control system 70B which works together with the traveling hydraulic system 30A, the controller 20 controls the solenoid valve(s) 65 based on the obstacle detection by the obstacle detector(s) 21 and/or 22 and the arm height detection by the arm height detector 23 (instead of based on the operation of the traveling operation lever 81) to stop the traveling device 5 (right traveling device 5R and left traveling device 5L) from moving such that the working device 4 (lift arms 10, AUX ports 11) approaches obstacle(s) (OB1, OB2 and/or the like) or to slow such movement, as a process to prevent the working device 4 (lift arms 10, AUX ports 11) from contacting the obstacle(s).

The controller 20 is capable of determining how actually close the working device 4 (lift arms 10 and AUX ports 11) is to obstacle(s) by reading the detected (actual) arm height from the arm height detector 23, and is also capable of predicting the traveling speed of the working machine 1 by reading the detected position of the traveling operation lever 81 from the lever position sensor 82. Furthermore, vehicle speed sensors and/or the like may be provided on the respective right and left traveling devices 5R and 5L to detect actual traveling speed. Therefore, the controller 20 is not only capable of determining how actually close the working device 4 is to obstacle(s), but is also capable of predicting changes in distance from the working device 4 to the obstacle(s) that would result from the travel of the working machine 1. Thus, the controller 20 is capable of starting, at an early stage of the approach of the working device 4 to the obstacle(s) that would result from the travel of the working machine 1, to control the solenoid valves 65 based on the prediction of how close the working device 4 will come to the obstacle(s).

The working machine 1 may include both the traveling operation lever 81 and the working operation lever 91, which are electric joysticks, as a traveling manipulator and a working manipulator. The working machine 1 may include both the traveling hydraulic system 30A and the working hydraulic system 40A. In such a case, a single control system may be used both as the control system 70A of FIG. 7 and the control system 70B of FIG. 8 and work together with both the traveling hydraulic system 30A and the working hydraulic system 40A.

Various changes, modifications, and improvements may be made to the working machine 1 including the obstacle detectors 21 and 22 (or either one of them) configured as described above and to the control system 70 (70A, 70B) including the controller 20 to perform, according to the detection by the obstacle detector(s) 21 and/or 22, a process to prevent the working device 4 from contacting obstacles as described above.

For example, the obstacle detectors 21 and 22 may be provided with a sweeper such as a wiper so that sensitivity does not decrease because of dust, muddy water, or the like.

For example, if it is unlikely that the obstacle detector 22 will detect objects such as a load L that should not be detected as an obstacle even when the arm height is lower than the predetermined position Pt, the obstacle detector 22 may always perform sensing to be used to also detect obstacles forward of the working machine 1.

The working machine 1 including the control system 70 including the obstacle detector(s) 21 and/or 22 as has been discussed achieves the following effects.

In a first aspect, a working machine 1 includes a machine body 2, a working device 4 including lift arm(s) 10 and provided on the machine body 2 movably up and down with respect to the machine body 2, a cabin 3 defining and functioning as a protector provided on the machine body 2 to protect an operator's seat 7 on the machine body 2, an obstacle detector 21 provided on the cabin 3 to detect obstacles OB1 and/or OB2 above the cabin 3, and a controller 20 configured or programmed, when the obstacle detector 21 detects an obstacle OB1 and/or an obstacle OB2 above the cabin 3, to perform at least one process to prevent the working device 4 from contacting the obstacle(s) OB1 and/or OB2.

With this, the obstacle OB1 and/or OB2 above the cabin 3 are/is detected, and the controller 20 performs the process to prevent the working device 4 from contacting the obstacle(s) OB1 and/or OB2, thus protecting the working device 4 (lift arms 10, especially, AUX ports 11) and the ceiling of an indoor facility or the upper edge of a doorway or the like, which are non-limiting examples of the obstacle(s) OB1 and/or OB2. Furthermore, the obstacle detector 21 provided on the cabin 3 can transmit a sensing medium such as ultrasonic waves S1 in a constant direction regardless of the up-and-down movement of the working device 4, thus eliminating or reducing the likelihood that there may be an undetectable area depending on the height-wise position of the working device 4 (arm height).

In a second aspect, a working machine 1 includes a machine body 2, a working device 4 provided on the machine body 2 movably up and down with respect to the machine body 2, the working device 4 including an AUX port 11 defining and functioning as a hydraulic fluid port to allow hydraulic fluid to be supplied from the working device 4 to an attachment 16 attached to the working device 4, a cabin 3 defining and functioning as a protector provided on the machine body 2 to protect an operator's seat 7 on the machine body 2, an obstacle detector 22 provided on the working device 4 and adjacent to the hydraulic fluid port 11 to detect obstacles OB1 and/or OB2 above the cabin 3, and a controller 2 configured or programmed to, when the obstacle detector 22 detects an obstacle(s) OB1 and/or OB2 above the cabin 3, perform at least one process to prevent the working device 4 from contacting the obstacle(s) OB1 and/or OB2.

With this, the obstacle OB1 and/or OB2 above the cabin 3 are/is detected, and the controller 20 performs the process to prevent the working device 4 from contacting the obstacle(s) OB1 and/or OB2, thus protecting the working device 4 (lift arms 10, especially, AUX ports 11) and the ceiling of an indoor facility, the upper edge of a doorway and/or the like, which are non-limiting examples of the obstacle(s) OB1 and/or OB2. Furthermore, since the obstacle detector 22 provided on the working device 4 and adjacent to the AUX port 11 detects the obstacle OB1 or OB2 above the cabin 3, the position of the obstacle OB1 or OB2 detected by the obstacle detector 22 refers to the position of the obstacle OB1 or OB2 relative to the AUX port 11, making it possible to easily understand how close the AUX port 11, which should be prevented from contacting the obstacle OB1 or OB2, is to the obstacle OB1 or OB2.

In the second aspect, the obstacle detector 22 may be configured to not perform sensing when the working device 4 is at or below a predetermined position Pt in a direction of movement thereof with respect to the machine body 2.

This makes it possible to eliminate or reduce the likelihood that, when the working device 4 is at or below the predetermined position Pt, the obstacle detector 22 will detect an object (such as a load L on an attachment 16) other than the obstacle OB1 or OB2 above the cabin 3 as an obstacle and the controller 20 will unnecessarily perform a process (such as sounding an alarm) to prevent the contact of the working device 4 with the obstacle and disturb work done by the working machine 1 rather than facilitating it.

In a third aspect, a working machine 1 includes a machine body 2, a working device 4 provided on the machine body 2 movably up and down with respect to the machine body 2, a cabin 3 defining or functioning as a protector provided on the machine body 2 to protect an operator's seat 7 on the machine body 2, a first obstacle detector 21 provided on the cabin 3 to detect obstacles OB1 and/or OB2 above the cabin 3, a second obstacle detector 22 provided on the working device 4 to detect obstacles OB1 and/or OB2 above the cabin 3 when the working device 4 is above a predetermined position Pt in a direction of movement thereof with respect to the machine body 2, and a controller 20 configured or programmed to, when the first obstacle detector 21 and/or the second obstacle detector 22 detect or detects an obstacle OB1 or OB2 above the cabin 3, perform at least one process to prevent the working device 4 from contacting the obstacle OB1 or OB2.

With this, the obstacle OB1 or OB2 above the cabin 3 is detected, and the controller 20 performs the process to prevent the working device 4 from contacting the obstacle OB1 or OB2, thus protecting the working device 4 (lift arms 10, especially, AUX ports 11) and the ceiling of an indoor facility or the upper edge of a doorway or the like, which are non-limiting examples of the obstacle OB1 or OB2. Furthermore, using the obstacle detector 21 that can detect the obstacle OB1 or OB2 regardless of the heightwise position of the working device 4 and the obstacle detector 22 that can detect changes in position of the working device 4 relative to the obstacle OB1 or OB2 as the heightwise position of the working device 4 changes, it is possible to more reliably detect the obstacle OB1 or OB2 above the cabin 3 and more reliably know how close the working device 4 is to the obstacle OB1 or OB2.

In the third aspect, the first obstacle detector 21 and the second obstacle detector 22 may be configured such that when the working device 4 is at or below the predetermined position Pt, the first obstacle detector 21 performs sensing and the second obstacle detector 22 does not perform sensing to allow obstacles OB1 and/or OB2 above the cabin 3 to be detected by the first obstacle detector 21, and when the working device 4 is above the predetermined position Pt, the first obstacle detector 21 does not perform sensing and the second obstacle detector 22 performs sensing to allow obstacles OB1 and/or OB2 above the cabin 3 to be detected by the second obstacle detector 22.

This makes it possible, when the working device 4 is at or below the predetermined position P, to prevent or reduce problems that would result from the obstacle detector 22 detecting an object other than the obstacle OB1 or OB2 above the cabin 3 as an obstacle, and possible, when the working device 4 is above the predetermined position Pt, to prevent or reduce problems that would result from the obstacle detector 21 detecting the working device 4 as an obstacle.

In the third aspect, the first obstacle detector 21 and the second obstacle detector 22 may each include an ultrasonic sensor. The first obstacle detector 21 may be positioned such that a direction of transmission of ultrasonic waves S1 from the first obstacle detector 21 is an upward direction. The second obstacle detector 22 may be positioned such that a direction of transmission of ultrasonic waves S2 from the second obstacle detector 22 approaches an upward direction as the working device 4 moves upward from the predetermined position Pt, and approaches a horizontal direction as the working device 4 moves downward from the predetermined position Pt.

This makes it possible, using the obstacle detector 21 to transmit the ultrasonic waves S1 upward regardless of changes in position of the working device 4 and the obstacle detector 22 to transmit the ultrasonic waves S2 such that the direction of transmission of the ultrasonic waves S2 approaches the upward direction as the working device 4 is raised, to reliably and economically detect the obstacle OB1 or OB2 above the cabin 3.

In each of the first, second and third aspects, the at least one process may include a process to reduce a movement speed of the working device 4 (lift arms 10) as the working device 4 approaches the obstacle OB1 or OB2.

This delays the approach of the working device 4 to the obstacle OB1 or OB2 resulting from the up-and-down movement of the working device 4. This is advantageous especially in, in a case where an attachment 16B such as a pallet fork is attached to the working device 4 and the working device 4 is repeatedly raised and lowered in an indoor space, preventing the AUX ports 11 projecting from the lift arm 10 from contacting the obstacle OB1 such as the ceiling above the cabin 3.

In each of the first, second and third aspects, the working machine 1 may further include a notifier 25. The at least one process may include a process to cause the notifier 25 to notify an operator seated on the operator's seat 7 of at least presence of the obstacle OB1 or OB2.

With this, an operator seated on the operator's seat 7 recognizes the presence of the obstacle OB1 or OB2 and is prompted to do something to prevent the AUX ports 11 and the like from contacting the obstacle OB1 or OB2.

The notifier 25 may include an indicator 28 to indicate a position of the working device 4 and a position of the obstacle OB1 or OB2 detected by the obstacle detector 21 and/or the obstacle detector 22.

This makes it possible for an operator seated on the operator's seat 7 to reliably recognize visually the position of the working device 4 and the position of the obstacle OB1 or OB2.

In each of the first, second, and third aspects, the working machine 1 may further include a traveling device 5 provided on the machine body 2. The at least one process includes a process to slow or stop the traveling device 5.

This delays or stops the approach of the working device 4 to the obstacle OB1 or OB2 resulting from the travel of the working machine 1. This is advantageous especially in, in a case where an attachment 16A such as a bucket is attached to the working device 4 and the working machine 1 enters and goes out of a facility carrying a load, preventing the AUX ports 11 projecting from the lift arm 10 from contacting the obstacle OB2 such as a doorway of the facility above the cabin 3.

In each of the first, second and third aspects, the working machine 1 may further include an attachment 16 attached to the working device 4. The controller 20 may be configured or programmed to determine, based on a type of the attachment 16 attached to the working device 4, whether to cause the first obstacle detector 21 and/or the second obstacle 22 to perform obstacle detection.

This makes it possible to prevent or reduce problems resulting from, for example, the obstacle detector(s) 21 and/or 22 frequently detecting grass or the like as obstacles during, for example, grass mowing in the bush in which objects other than the obstacle above the cabin 3 are likely to be frequently detected as an obstacle.

The working machine 1 may further include a memory 20*b* to store a list of a plurality of types of attachments 16 and pieces of information regarding whether to cause the obstacle detector 21 and/or the obstacle detector 22 to perform obstacle detection that correspond to the respective plurality of types of attachments 16, and a selector 23 located near the operator's seat 7 and operable by an operator seated on the operator's seat 7 to select a type of attachment 16 which is one of the plurality of types of attachments 16 stored in the memory 20*b*. The controller 20 may be configured or programmed to determine, based on the type of attachment 16 selected using the selector 23, whether to cause the obstacle detector 21 and/or the second obstacle detector 22 to perform the obstacle detection.

With this, the operator only needs to select a corresponding attachment 16 from a list displayed by the attachment selector 24. The operator themselves does not need to determine whether to perform the obstacle detection. It is also unnecessary to store information regarding the determination of whether to perform the obstacle detection in a memory included in each attachment 16.

An attachment 16 attached to the working device 4 may include a memory 16*a* to store information that is regarding whether to cause the obstacle detector 21 and/or the obstacle detector 22 to perform obstacle detection and that corresponds to a type of the attachment 16, and may include a communication function to transmit a signal corresponding to the information. The controller 20 may be configured or programmed to receive the signal transmitted from the attachment 16 attached to the working device 4 and determine whether to cause the first detector and/or the second detector to perform the obstacle detection.

With this, when the operator selects an attachment 16 suitable for intended work and attaches the attachment 16 to the working device 4, whether to perform the obstacle detection is automatically determined appropriately for the selected attachment 16. The operator does not have to select whether to perform the obstacle detection in consideration of the substance of the work done using the attachment 16.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a traveling device provided on the machine body;

a working device to which an attachment is attached or is to be attached, the working device being provided on the machine body such that the attachment is swingable up and down in front of the machine body;

a protector provided on the machine body to protect an operator's seat on the machine body;

a detector provided on the protector to detect an obstacle located at a position forward of the protector and higher than the protector; and a controller configured or programmed to, when the detector detects the obstacle, perform at least one process to prevent the working device from contacting the obstacle.

2. The working machine according to claim 1, wherein the controller is configured or programmed to perform the at least one process to reduce a movement speed of the working device as the working device approaches the obstacle.

3. The working machine according to claim 1, further comprising a notifier; wherein the controller is configured or programmed to perform the at least one process to cause the notifier to notify an operator seated on the operator's seat of at least presence of the obstacle.

4. The working machine according to claim 3, wherein the notifier includes an indicator to indicate a position of the working device and a position of the obstacle detected by the detector.

5. The working machine according to claim 1, wherein the controller is configured or programmed to perform the at least one process to slow or stop the traveling device.

6. The working machine according to claim 1, wherein each of different types of attachments is selectively attachable to the working device; and the controller is configured or programmed to determine, based on a type of the attachment attached to the working device, whether to cause the detector to perform obstacle detection.

* * * * *